US012600595B2

(12) United States Patent
Dettori et al.

(10) Patent No.: US 12,600,595 B2
(45) Date of Patent: Apr. 14, 2026

(54) MACHINE FOR PRODUCING LAMINAR PRODUCTS MADE OF PAPER MATERIAL, IN PARTICULAR PACKAGES OF NAPKINS, TISSUES OR SIMILAR PRODUCTS AND RELATED PRODUCTION METHOD

(71) Applicant: VALMET TISSUE CONVERTING S.R.L., Porcari (IT)

(72) Inventors: Daniele Dettori, Capannori (IT); Massimo Bianchi, Viareggio (IT); Graziano Dini, Bagni di Lucca (IT)

(73) Assignee: VALMET TISSUE CONVERTING S.R.L., Porcari (IT)

( * ) Notice: Subject to any disclaimer, the term of this patent is extended or adjusted under 35 U.S.C. 154(b) by 232 days.

(21) Appl. No.: 18/685,169

(22) PCT Filed: Aug. 12, 2022

(86) PCT No.: PCT/IB2022/057554
§ 371 (c)(1),
(2) Date: Feb. 20, 2024

(87) PCT Pub. No.: WO2023/021386
PCT Pub. Date: Feb. 23, 2023

(65) Prior Publication Data

US 2024/0351819 A1 Oct. 24, 2024

(30) Foreign Application Priority Data

Aug. 20, 2021 (IT) ..... 102021000022133

(51) Int. Cl.
*B65H 45/24* (2006.01)
*B65H 23/04* (2006.01)
(Continued)

(52) U.S. Cl.
CPC ..... *B65H 45/24* (2013.01); *B65H 23/044* (2013.01); *B65H 23/1825* (2013.01);
(Continued)

(58) Field of Classification Search
CPC ..... B65H 45/16; B65H 45/20; B65H 45/24; B65H 23/044; B65H 23/1825;
(Continued)

(56) References Cited

U.S. PATENT DOCUMENTS 3,490,762 A 1/1970 Nystrand
5,598,758 A 2/1997 Chmelar
(Continued)

FOREIGN PATENT DOCUMENTS

EP 1 520 822 A2 4/2005
EP 1 630 118 A1 3/2006
EP 1 457 444 B1 11/2011

*Primary Examiner* — Leslie A Nicholson, III
(74) *Attorney, Agent, or Firm* — Maschoff Brennan

(57) ABSTRACT

A machine (1) for producing packages of napkins, tissues, towels, or similar products, comprises a support frame (100) to support a feeding group (10) which feeds a first and a second web of paper (5*a*, 5*b*). The support frame (100) supports, furthermore, a cutting group (20) which cuts the first and second webs of paper (5*a*, 5*b*) respectively in a first and a second plurality of sheets (6) of predetermined length, and a folding or interfolding group (30) which folds or interfolds the sheets of paper (6) at a folding or interfolding zone, (35) in such a way to obtain a stack (150) of folded or interfolded sheets, according to a predetermined folding or interfolding configuration. The cutting group (20) and the folding or interfolding group (30) are mounted on the same support body (110) to move between an assembled position in which is supported by the support frame (100), and a disassembled position, in which is not supported by the support frame (100). A displacement group (50) is, furthermore, provided to displace the support body (110) between
(Continued)

the assembled position and the disassembled position. The displacement group (50) and the support body (110) are provided with respective engagement portions (58,118) to engage with each other in such a way to allow the displacement group (50) to displace the support body (110) between the assembled position and the disassembled position.

20 Claims, 27 Drawing Sheets

(51) Int. Cl.
*B65H 23/182* (2006.01)
*B65H 27/00* (2006.01)
*B65H 35/00* (2006.01)
*B65H 45/16* (2006.01)

(52) U.S. Cl.
CPC ..... *B65H 27/00* (2013.01); *B65H 35/0006* (2013.01); *B65H 45/16* (2013.01); *B65H 2301/452* (2013.01); *B65H 2406/33* (2013.01); *B65H 2701/1924* (2013.01)

(58) Field of Classification Search
CPC ..... B65H 27/00; B65H 35/0006; B65H 2301/452; B65H 2406/33; B65H 2701/1924; B65H 2601/324; B65H 2402/10
See application file for complete search history.

(56) References Cited

U.S. PATENT DOCUMENTS

| | | | | |
|---|---|---|---|---|
| 6,228,014 | B1 | 5/2001 | De Matteis et al. | |
| 6,852,073 | B2 | 2/2005 | Neumann et al. | |
| 7,060,016 | B2 | 6/2006 | Cipolli | |
| 7,121,994 | B2 * | 10/2006 | Haasl | B65H 45/24 493/405 |
| 7,517,309 | B2 * | 4/2009 | De Matteis | B65H 45/24 493/411 |
| 8,926,486 | B2 * | 1/2015 | Diehr | B44B 5/00 493/478 |
| 10,196,228 | B2 * | 2/2019 | Allen | B65H 45/20 |

* cited by examiner 1
20a
110a
32a
31a
110b
31b
50'b
50'a
113b
32b
50b
50a
113a
50"a
50"b
100

MACHINE FOR PRODUCING LAMINAR PRODUCTS MADE OF PAPER MATERIAL, IN PARTICULAR PACKAGES OF NAPKINS, TISSUES OR SIMILAR PRODUCTS AND RELATED PRODUCTION METHOD

FIELD OF THE INVENTION

The present invention relates to the technical field of paper converting, and similar products, and, in particular, relates to a machine for interfolding a web or sheet of paper equipped with an innovative folding or interfolding unit, in particular able to cut the web in sheets of predetermined length before folding or interfolding them.

BACKGROUND OF THE INVENTION

As it is known, in the paper industry many types of machines and processes are used for producing paper tissues, towels, and similar products in packages of interfolded sheets of a determined height. These are obtained by folding the sheets in an "interfolded" way that means closing at each fold a final edge of the previous sheet and a starting edge of the following sheet.

In this way, at the moment of its use, when a sheet is extracted from the package, also an initial edge of the following sheet is extracted, thus simplifying its use for some kinds of uses.

The interfolding machines of known type work one or more webs of paper coming from one or more reels and that are cut at a cutting unit into sheets of predetermined length, and staggered fed to a folding unit at which 2 counter-rotating folding rolls work. More precisely, the cut into sheets of the webs is carried out on cutting rolls which alternately cooperate with related counter-blades.

Among the possible ways to fold the sheets, are known, in particular, the "L" and "V" interfolded, with 2 panels, the "Z" interfolded, with 3 panels, and the "W" interfolded, with 4 panels.

In the case of "L" and "V" interfolded, obtained by "single-fold" machines, of the type that is for example described in U.S. Pat. No. 6,228,014, the webs of paper are cut in such a way to form two staggered sequences of sheets which are alternately fed to the folding rolls. In this way, each sheet coming from a first direction is superimposed, for about half sheet, to a portion of the sheet coming from a second direction, and vice versa, at the moment in which the fold is carried out.

In the case of "Z", "W", or even more interfolded panels, obtained by the so called "multi-fold" machines of the type for example described in U.S. Pat. No. 3,490,762, only one web of paper is worked and, a sequence of sheets, which are already partially superimposed to each other, reaches the folding rolls from a single direction. As described in EP1520822, the superimposition between two following sheets is carried out immediately after the cut by a transfer roll and a delay roll, which together carry out a small fold at a previous sheet under which the following sheet is in part positioned.

Both in the single-fold and in the multi-fold machines, the folding rolls have a circumference whose length is a multiple of the panel length. In particular, in order to fold or interfold the sheets, the folding rolls are provided with retaining devices, such as suction holes, or mechanical pliers, which are synchronously operated for alternately starting and finishing each fold between two following panels.

For example, as described in EP1457444B1 which provides advancing rolls and folding rolls having suction holes, a first series of holes holds the sheets on a folding roll for a determined angular distance, and then "passes" them to the other folding roll also this provided with a parallel retaining device with suction holes, which works for another predetermined angular distance. Through this controlled "passage" of the sheet or web of paper from a folding roll to another one, the desired folding or interfolding configuration is carried out obtaining a stack of folded or interfolded sheets. Since the "panel length", which determines the width of the package of folded sheets exiting the machine, is a submultiple of the circumferential development of the folding rolls, is, therefore, one of the main structural constraints of the folding machines, which impede to change the length of the panels without completely replacing the folding rolls.

Therefore, both in the case of multi-fold machines and in the case of single-fold machines of prior art, it is necessary to provide both the folding or interfolding rolls, and at least one cutting roll, in addition to the rolls which transfer the sheets cut by the cutting roll to the folding or interfolding rolls. Therefore, in addition to be complex from a structural point of view, the prior art machines have a great size. Furthermore, in the known machines, it is necessary to have suction rolls both for the cutting rolls and for the folding or interfolding rolls, resulting in high energy consumption for generating the vacuum necessary for aspiration.

Furthermore, both the multi-fold machines, and the single-fold machine of known type, have a high production rigidity, because, as anticipate above, both the folding or interfolding rolls, and the cutting rolls have a predetermined circumference whose length is a multiple of the panel length, whereby they are able to produce only a particular type of product.

In EP1630118 an interfolding machine is described having a support structure comprising a folding section at which the sheets are fed to the folding rolls staggered to each other, and, then, folded in such a way to obtain a determined interfolding configuration. The folding section provides a modular structure comprising a portion that can be removed and replaced with an equivalent portion, but adapted to work with a different length of the panels.

Even though the solution described in EP1630118 allows to make the machine a bit versatile because it allows to diversify the production of the machine, however, it requires long times to carry out the replacement of a module with another one having different characteristics with a not negligible loss of productivity. In particular, both the removal of the module from the machine and the installation of a new module are carried out by sliding the module along tracks parallel to the rolls of the machine. Therefore, the machine described in EP1630118 has a big size in the direction longitudinal to the rolls, because it requires to have an available manoeuvring area having a length which is, at least, comparable to the length of the removed rolls. It is, furthermore, suitable to note that EP1630118 does not describe in detail the devices that are able to cause the aforementioned sliding of the modules.

A drawback of the solution described in EP1630118 relates, in particular, the replacement of the folding section. This, in fact, comprises both the cutting rolls and the folding rolls and the separation groups, in particular the detaching fingers which operate the detachment of the sheets from the surface of the folding rolls once that the replacement of the module has been made, have to be necessarily repositioned in phase with the new folding rolls, operation which is very complex.

SUMMARY OF THE INVENTION

It is, therefore, an object of the present invention to provide a machine for producing packages of laminar products, such as packages of napkins, tissues and similar products, able to overcome the aforementioned drawbacks of the prior art solutions.

It is, in particular, an object of the present invention to provide a machine for producing packages of laminar products, such as packages of napkins, tissues and similar products which allows to easily and quickly replace a portion of the machine with another one having the same functions.

It is, in particular, an object of the present invention to provide a machine for producing packages of laminar products, such as packages of napkins, tissues and similar products which allows to reduce the overall longitudinal dimension of the machine with respect to analogous solutions of prior art.

It is also an object of the present invention to provide a method producing packages of laminar products having analogous advantages.

These and other objects are achieved by a machine for producing packages of laminar products made of paper material folded or interfolded, in particular packages of napkins, tissues, towels, or similar products, said machine comprising a support frame configured to support:

- a feeding group configured to feed a first and a second web of paper, respectively, along a first and a second predetermined feeding direction;
- a cutting group configured to cut said first and second web of paper respectively into a first and into a second plurality of sheets of predetermined length;
- a folding or interfolding group equipped with a first and second counter-rotating folding roll adapted to rotate about respective longitudinal rotation axes and configured to fold or interfold said first and second pluralities of sheets of paper at a folding or interfolding zone, in such a way to form a stack of folded or interfolded sheets, according to a predetermined folding or interfolding configuration, said cutting group, and said folding or interfolding group, being mounted on the same support body configured to move between an assembled position, where is supported by said support frame, and a disassembled position, where is not supported by said support frame;

whose main characteristic is that displacement group is, furthermore, provided configured to displace the support body between said assembled position and said disassembled position, and that said displacement group and said support body are provided with respective engagement portions configured to engage with each other in such a way to allow said displacement group to cause said displacement of said support body between the assembled position and the disassembled position with respect to said support frame.

Other features of the invention are and related embodiments are set out in the dependent claims.

In particular, the displacement group can be configured to move the support body from the assembled position to the disassembled position by lifting the support body from the support frame, in particular up to a predetermined height q1. More in particular, the displacement group can be, furthermore, configured to displace the support body from the disassembled position to the assembled position by lowering the support body on the support frame, in particular starting from the aforementioned predetermined height q1.

Advantageously, the displacement group can be configured to move the support body along a first displacement direction and at least a second displacement direction.

In particular, the first and second displacement directions can be orthogonal to each other.

In particular, the displacement group can be configured to lift, or lower, the support body causing the displacement of the same along the aforementioned first displacement direction. More in particular, the displacement can be configured, furthermore, to displace the support body in the raised position from or towards the support frame causing the same to slide along the aforementioned second displacement direction.

In an embodiment foresee by the invention, the aforementioned displacement group can be configured to displace the support body between the assembled position and the disassembled position by a rotation about at least a rotation axis, preferably parallel to the longitudinal rotation axes of the first and second rolls. In a further alternative embodiment provided by the invention, the displacement group can be adapted to displace the support body between the assembled position and the disassembled position by at least a translation and at least a rotation.

In particular, a motor group can be, furthermore, configured to cause at least one between the first and second folding or interfolding rolls to rotate about the respective rotation axis. More in particular, the motor group can comprise a motor and a motion transmission device adapted to transmit the rotational motion of the motor shaft of the aforementioned motor to at least one between the first and second folding or interfolding roll.

Advantageously, the transmission group of the motion can comprise at least one motion transmission member, for example a transmission belt, adapted to cause the aforementioned rotation of at least one folding or interfolding roll, about the respective longitudinal axis.

Preferably, a group for adjusting the tension can be, furthermore, provided configured to adjust the tension of the or each motion transmission member, in particular of the aforementioned transmission belt.

In particular, the aforementioned group for adjusting the tension can be configured to keep the tension of the motion transmission member, substantially constant, or constant. More in particular, the group for adjusting the tension can be configured to keep constant or substantially constant, the tension of the motion transmission member during the movement of the support body from the assembled position to the disassembled position that is carried out by said displacement group.

In a possible embodiment, the group for adjusting the tension can comprise a measurement device configured to directly or indirectly measure the tension on the transmission belt, for example a force sensor, in particular a load cell.

Preferably, the aforementioned measurement device is operatively connected to a processing device configured to operate an actuation device adapted to cause a lengthening or a shortening of the path of the or each motion transmission member depending on a tension signal measured by the aforementioned measurement device.

Advantageously, each said first and second folding or interfolding roll comprises:

- a tubular body configured to rotate about a respective longitudinal rotation axis, said tubular body being provided with a plurality of suction holes organized in a plurality of couples of longitudinal rows close to each other;

a vacuum distribution device configured to selectively pneumatically connect a vacuum generation device configured to generate a predetermined vacuum degree to at least one row of the aforementioned plurality of rows of suction holes, at predetermined angular positions of said tubular body, in such a way to cause said first and second pluralities of worked sheets of paper to be sucked and therefore to adhere at predetermined portions of the first and second folding or interfolding roll.

Preferably, only one vacuum generation device is provided that is operatively connected to the vacuum distribution device of the first and of the second folding or interfolding roll.

Alternatively, can be provided:

a first vacuum generation device connected to the vacuum distribution device of the first folding or interfolding roll; and a second vacuum generation device connected to the vacuum distribution device of the second folding or interfolding roll.

In particular, the vacuum distribution device of the first and of the second folding or interfolding roll, and the or each vacuum generation device are pneumatically connected to each other by a connection duct.

More in particular, the aforementioned connection duct comprises:

a first portion integral to the vacuum distribution device;

a second portion integral to the vacuum generation device, said first and second portions being configured to move between a connection configuration in which are adapted to pneumatically connect the vacuum generation device to the vacuum distribution device, and a disconnection configuration in which are adapted to pneumatically disconnect the vacuum distribution device from the vacuum generation device.

In a possible embodiment, the connection duct comprises, furthermore, a third portion configured to move from a connection position for connecting the first and second portions of the connection duct, and a disconnection position for disconnecting the first and the second portion of the connection duct.

In particular, the third portion can be slidingly mounted with respect to the first and second portions of the connection duct. More in particular, the third portion can be configured to move between a retracted position corresponding to the disconnection position, and an advanced position corresponding to the connection position. Advantageously, at least one sealing element is, furthermore, provided positioned between the third portion, in particular between internal surface of the third portion, and the first and/or the second portion, in particular the external surface of the first and/or of the second portion.

Advantageously, a first and a second sealing element can be provided adapted to be positioned between the first and the third portion and between the second and the third portion, respectively, at the aforementioned advanced position.

In particular, the or each sealing element can be configured to move from a working configuration, where is adapted to exert a sealing action to pneumatically isolate the first and second portions of the connection duct from the external environment, and a rest configuration, where is not adapted to exert a sealing action. For example, the or each sealing element can be pneumatically connected to an inflating device adapted to cause it to move from the rest configuration to the working configuration, in particular by introducing air or another gas, into each sealing element.

Preferably, can be, furthermore, provided:

a first and a second plurality of detaching fingers configured, respectively, to alternately cause the detachment of the folded or interfolded sheets of paper, from the first and second folding or interfolding roll;

a first and a second driving group configured, respectively, to cause an oscillatory back and forth motion of the first and of the second plurality of detaching fingers towards/from said folding or interfolding zone, in such a way to cause the detachment of the folded or interfolded sheets of paper, respectively, from the first and second folding or interfolding roll.

In particular, the first and second driving groups can be, furthermore, associated to a first and a second phase adjustment group configured to delay or anticipate the oscillatory motion of the first and second pluralities of detaching fingers with respect to a predetermined reference oscillatory motion, in such a way to delay or anticipate the instant (tr) at which the first and second pluralities of detaching fingers are adapted to alternately respectively cause the detachment of the folded or interfolded sheets of paper, from the first and second folding or interfolding roll.

More in particular, the first and second driving groups can be adapted to bring, respectively, the first and second pluralities of detaching fingers in predetermined reference position, in particular before that the displacement group is adapted to displace the support body between the assembled position and the disassembled position. In this way, it is ensured that at the moment of positioning a new support body on the support frame, no interference occurs between the different parts which remain on the support frame, in particular the detaching fingers and the parts that are mounted on the support body.

In particular, in that the folding or case interfolding rolls are provided with counter-blades, in particular integral to the roll, it is avoided that these can interfere with the detaching fingers. Furthermore, in this way, t is possible to speed up the starting operation of the machine once that a support body has been replaced with another. In other words, in this way it is possible to significantly reduce the downtime of the machine necessary to complete the operation.

Advantageously, the aforementioned engagement portions of the support body of the displacement group can be configured to reversibly move from an engagement configuration to a disengagement configuration. In particular, the aforementioned engagement portions of the support body and of the displacement group can be adapted to move from the engagement position to the disengagement position by translating with respect to each other in a first translation direction and from the disengagement position to the engagement position by translating with respect to each other in a second translation direction opposite to the first one.

Advantageously, a separation group can be, furthermore, provided configured to separate a finished stack of folded or interfolded sheets, from a following stack once that a predetermined height of the aforementioned stack to be formed is reached.

In particular, the aforementioned cutting group can comprise a first and a second cutting device provided, respectively, with at least a first and a second cutting blade. More in particular, the first and second cutting devices can be associated, respectively, to the first and second folding or interfolding rolls. These are, advantageously, respectively, provided with a first and a second plurality of counter-blades distributed peripherally to the first and to the second folding or interfolding roll.

Advantageously, the first and second pluralities of counter-blades are configured to operate, respectively, in combination with the first and with the second cutting blades of the cutting device to divide a first and a second web of paper, or similar products, in the first and in the second plurality of sheets.

In particular, the separation group comprises a first and second pluralities of separation members configured to move between a first position and a second position to cause the aforementioned separation of a finished stack from a stack to be formed. More in particular, the first and second pluralities of separation members are configured to move from the first to the second position moving along a respective movement trajectory external to the encumbrance of the first and of the second folding or interfolding roll, in such a way not to intersect the first and second pluralities of counter-blades.

According to a further aspect of the invention, a method for producing packages of folded or interfolded laminar products made of paper material, in particular packages of napkins, tissues, towels, or similar products, provides the steps of:

feeding a first and a second web of paper respectively along a first and a second feeding direction;

cutting by a cutting group said first and second webs of paper respectively into a first and into a second plurality of sheets of predetermined length;

folding or interfolding said first and second pluralities of sheets of paper at a predetermined folding or interfolding zone, said folding or interfolding step being carried out by a folding or interfolding group comprising a first and a second folding or interfolding roll counter-rotating with respect to each other between which said folding or interfolding zone is defined;

said cutting group and said folding or interfolding group being mounted on the same support body configured to move between an assembled position where is supported by a support frame, and a disassembled position, where is not supported by said support frame;

whose main characteristic is that a displacing step is, furthermore, provided for displacing the support body between said assembled position and said disassembled position, and that said displacing step is carried out by engaging said displacement group and said support body at respective engagement portions in such a way to allow said displacement group to cause said movement of said support body between the assembled position and the disassembled position with respect to said support frame.

In particular, at least a first and a second support body can be provided and wherein are provided the steps of:

engaging by said engagement portion said first support body and said displacement group at a working area;

displacing said first support body by said displacement group from said working area up to a store area;

positioning said first support body at a first storing position that is present in said store area;

disengaging said support group and said displacement group from each other;

positioning said displacement group at a second storing position that is present in said store area at which said second support body is positioned;

engaging by said engagement portion said second support body and said displacement group;

displacing said second support body from said store area to said working area;

disengaging said second support body and said displacement group from each other causing the movement of said respective engagement portions from said engagement position to said disengagement position.

Advantageously, a first and a second plurality of detaching fingers can be, furthermore, provided configured to cause the detachment of the folded or interfolded sheets of paper, respectively from said first and from said second folding or interfolding roll and wherein, furthermore, are provided the steps of:

positioning said detaching fingers in a predetermined reference position;

displacing by said displacement group said first support body from said working area to said store area;

displacing by said displacement group said second support body from said store area to said working area;

positioning said detaching fingers from said reference position to a working position.

In particular, a vacuum distribution device can be, furthermore, provided configured to selectively pneumatically connect a vacuum generation device configured to generate a predetermined vacuum degree to at least one row of the aforementioned plurality of rows of suction holes, at predetermined angular positions of the tubular body, in such a way to cause the first and second pluralities of worked sheets of paper to be sucked and to adhere at predetermined portions of the folding or interfolding roll, said vacuum distribution device and said vacuum generation device being adapted to be pneumatically connected to, or disconnected from, each other by a connection duct comprising:

a first portion integral to said vacuum distribution device;

a second portion integral to the vacuum generation device, said first and second portions being configured to move between a connection configuration where are adapted to pneumatically connect said vacuum generation device to said vacuum distribution device, and a disconnection configuration;

and wherein the steps are provided of:

causing said first and said second portion to move from said connection configuration to said disconnection configuration, before displacing, by said displacement group, said first support body from said working area to said store area;

causing said first and second portions to move from said disconnection configuration to said disconnection configuration, once that has been displaced, by said displacement group, said second support body from said store area to said working area up to reach said assembled position.

BRIEF DESCRIPTION OF THE DRAWINGS

The invention will be now illustrated with the following description of an exemplary embodiment thereof, exemplifying but not limitative, with reference to the attached drawings wherein.

DETAILED DESCRIPTION OF SOME EXEMPLARY EMBODIMENTS OF THE INVENTION

Figure 1:
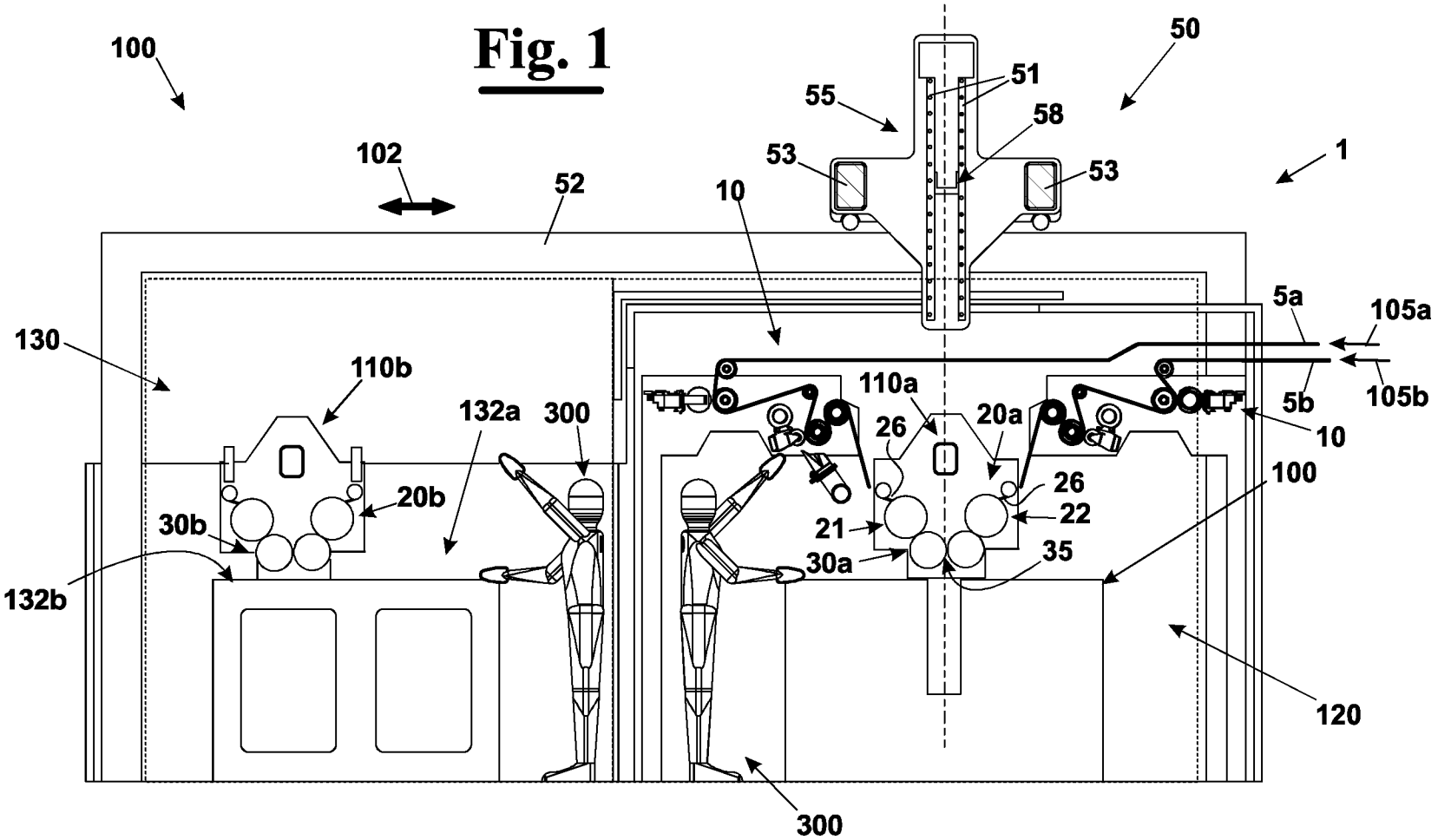
FIG. 1 diagrammatically shows a side elevation perspective partially sectioned view of a machine, according to the invention, for producing packages of laminar products made of paper, in particular packages of napkins, tissues and towels, in which a support body provided with a first type of cutting group is installed.

In FIG. 1, it is diagrammatically shown a first embodiment provided by the present invention of a machine 1 for producing packages of folded or interfolded laminar products made of paper material, in particular packages of napkins, tissues, towels, or similar products.

The machine 1 comprises, in particular, a support frame 100 configured to support a feeding group 10 adapted to feed at least one web of paper 5, preferably a first and a second web of paper 5*a* and 5*b*, along a respective predetermined feeding direction 105*a* and 105*b*. The machine 1 comprises a folding or interfolding group 30 equipped with a first and a second folding or interfolding roll 31 and 32. A cutting group 20 is, furthermore, provided configured to cut the, or each, web of paper 5 into a respective plurality of sheets 6 of predetermined length. This is determined, in particular, by the diameter of the folding or interfolding rolls 31 and 32 and, if present, by the diameter of the cutting rolls 21 and 22 of the cutting group 20 as well as by the number of blades 26 which are mounted on the same. The folding or interfolding rolls 31 and 32 are configured to rotate about respective longitudinal rotation axes 131 and 132 in such a way to be counter-rotating with respect to each other, and to fold or interfold the or each aforementioned plurality of sheets of paper 6 at a folding or interfolding zone 35. In this way a stack 150 is obtained of sheets which are folded or interfolded according to a predetermined folding or interfolding configuration growing in height along a predetermined forming direction. In particular, the cutting group 20 and the folding or interfolding group 30 are mounted on the same support body 110. More in particular, the support body 110 is configured to move between an assembled position, in which is supported by the support frame 100, and a disassembled position, in which is, instead, not supported by the support frame 100. Preferably, once that the support body 110 has been moved to the disassembled position, it can be positioned in a store area 130, for example in order to be subject to ordinary or extraordinary maintenance operations, before being positioned, again, in the machine 1, and precisely on the support frame 100.

According to the present invention, the machine 1, furthermore, comprises a displacement group 50 configured to displace the support body 110 between the assembled position and the disassembled position. More in detail, the displacement group 50 and the support body 110 are provided with respective engagement portions 58 and 118 configured to engage with each other, in particular in a removable way, in such a way to allow the displacement group 50 to cause the displacement of the support body 110 between the assembled position and the disassembled position with respect to the support frame 100.

Preferably, the displacement group 50 is configured to cause the movement of the support body 110 from the assembled position to the disassembled position by lifting the same from the support frame 100, and the opposite movement, i.e. from the disassembled position to the assembled position, by lowering the support body on the support frame 100.

Advantageously, the displacement group 50 can be configured to displace the support body 110 at least along a first displacement direction 101. In particular, the first direction 101 can be a direction orthogonal to the longitudinal axes 131 and 132 of the folding or interfolding rolls 31 and 32. More precisely, the first direction 101 can be the direction along which the displacement group 50 is adapted to cause the aforementioned lifting with respect to the support frame 100 to move the support body 110 same from the assembled position to the disassembled position, or the aforementioned lowering, to move, instead, the support body 110 from the disassembled position to the assembled position. More in particular, the aforementioned displacement group 50 can be, furthermore, configured to displace the support body 110 along a second displacement direction 102. For example, the aforementioned displacement direction 102 can be a direction orthogonal to the first displacement direction 101.

In particular, in the embodiment diagrammatically shown in FIG. 1, the cutting group 20 can provide a first and a second cutting roll 21 and 22 associated respectively to the first and to the second folding or interfolding roll, 31 and 32. More precisely, the cutting rolls 21 and 22 can be peripherally provided with a predetermined number of blades, and rotate about respective longitudinal axes to cut and, therefore, to divide, a respective web of paper 5*a*, 5*b* into a respective plurality of sheets 6 by operating in combination with a respective fixed counter-blade.

Figure 20:
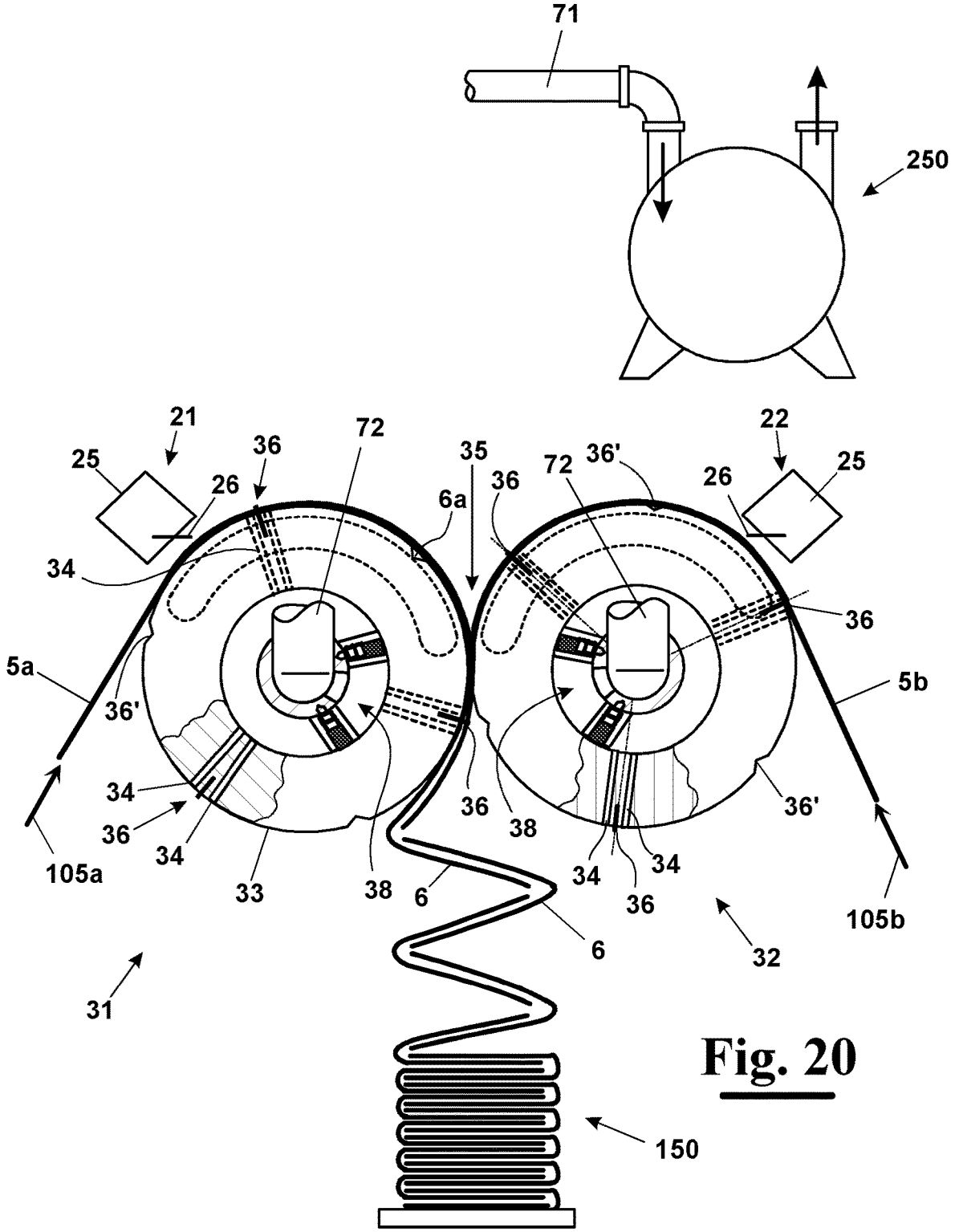
FIG. 20 diagrammatically shows a partially sectioned view of a possible embodiment of the folding group of a support body that can be installed on the machine according to the invention.

In an alternative embodiment provided by the present invention and diagrammatically shown from FIG. 2 to FIG. 11, and in detail in FIG. 20, the cutting group 20 can be of the type described in WO2020161571 in the name of the same Applicant. In particular, the cutting group 20 can comprise a first and a second fixed cutting device 21 and 22 respectively associated to the first and to the second folding or interfolding roll 31 and 32. More in detail, in this case the first and the second cutting device 21 and 22 comprises, respectively, a base portion 25 provided with at least a cutting blade 26. In this case, the first and second folding or interfolding rolls 31 and 32 are provided with respective pluralities of counter-blades 36 distributed along the respective tubular body. Therefore, the cut of each web 5*a*, or 5*b*, in a respective plurality of sheets 6 is carried out directly on the folding or interfolding rolls 31 and 32 which then provide to fold or interfold the sheets 6 same according to a predetermined folding or interfolding configuration. In particular, the folding or interfolding rolls, 31 and 32 can be also peripherally provided with recesses 36' and the aforementioned counter-blades 36 alternating to each other, in such a way to avoid that at the folding zone 35 the counter-blades 36 of a roll 31 or 32 can compromise the folding or interfolding operation and/or cut the worked sheets 6.

Figure 2:
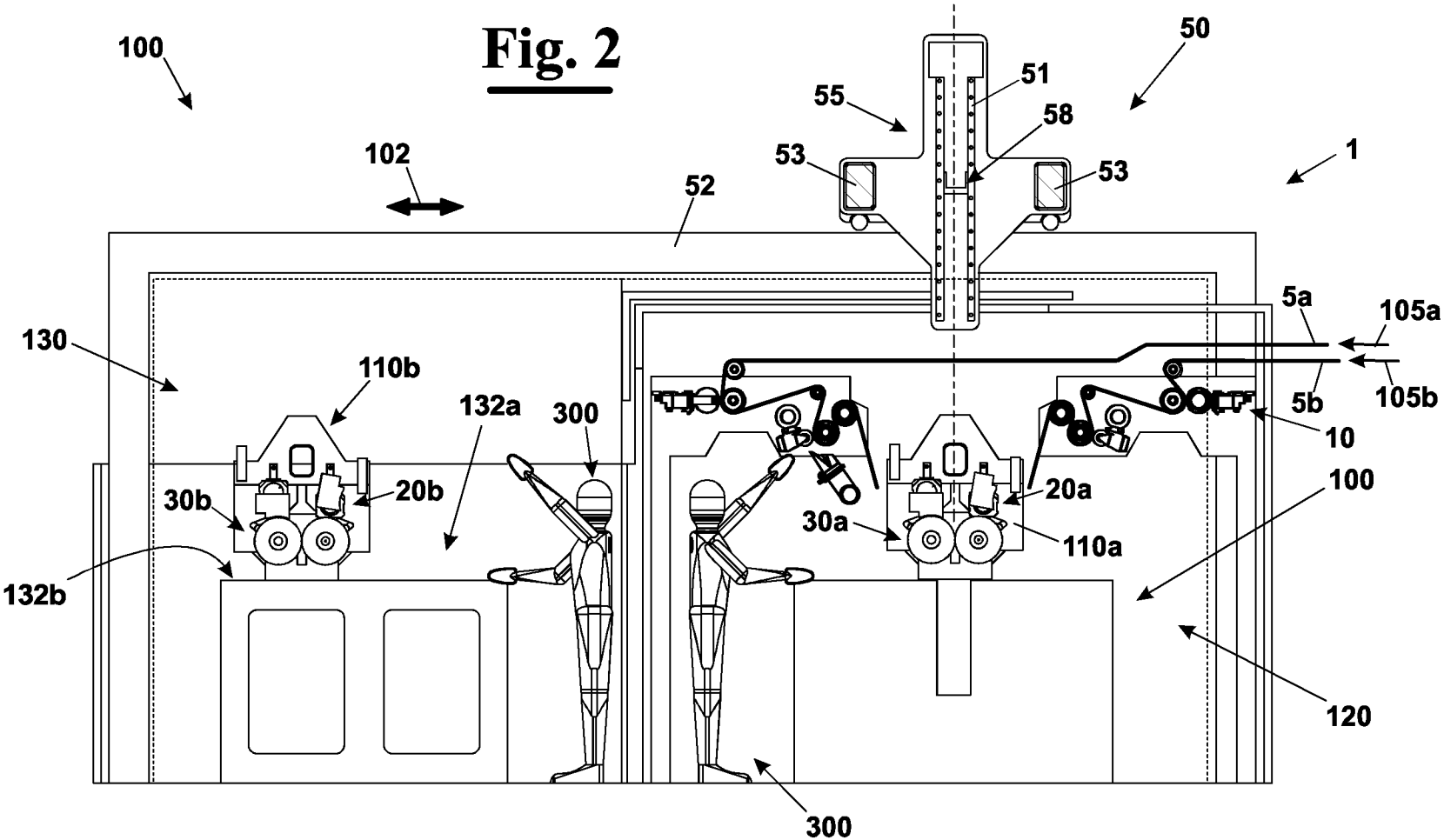
FIGS. 2 to 10 diagrammatically show a side elevation perspective partially sectioned view of some different working configurations of the machine, according to the invention, for producing packages of laminar products di carta, in particular packages of napkins, tissues and towels, in which a support body provided with a second type of cutting group is installed.
Figure 3:
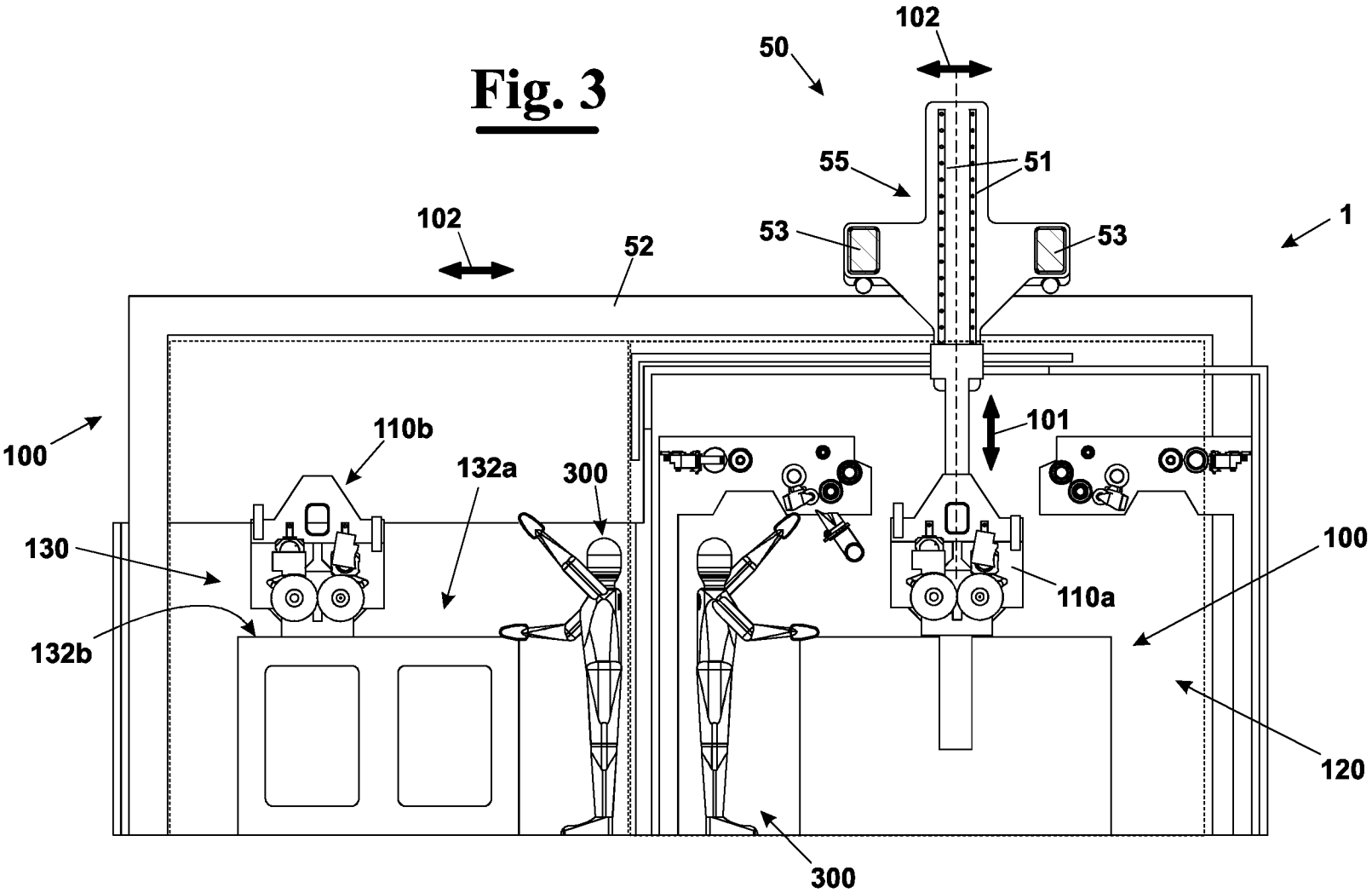
Figure 4:
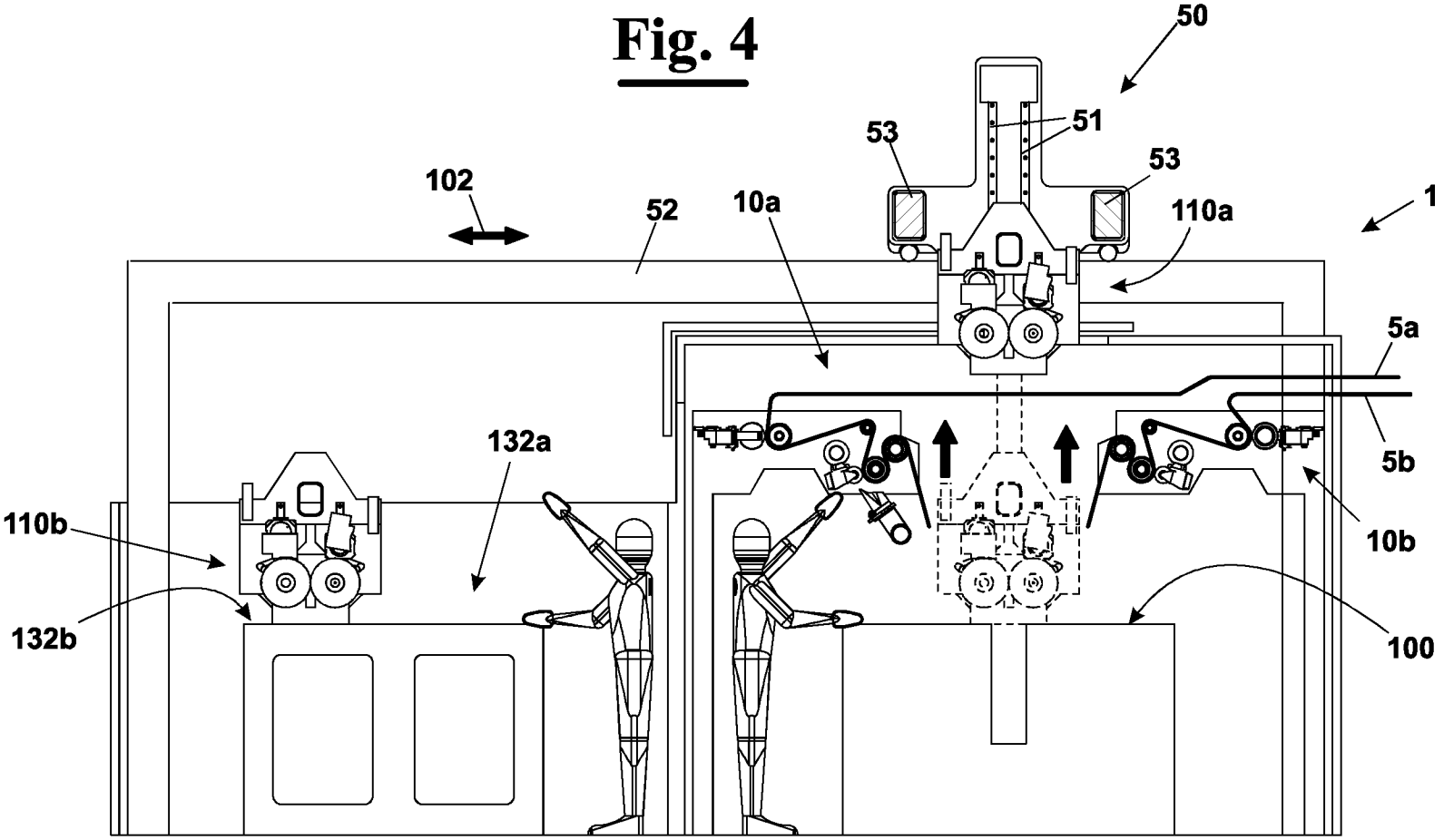
Figure 5:
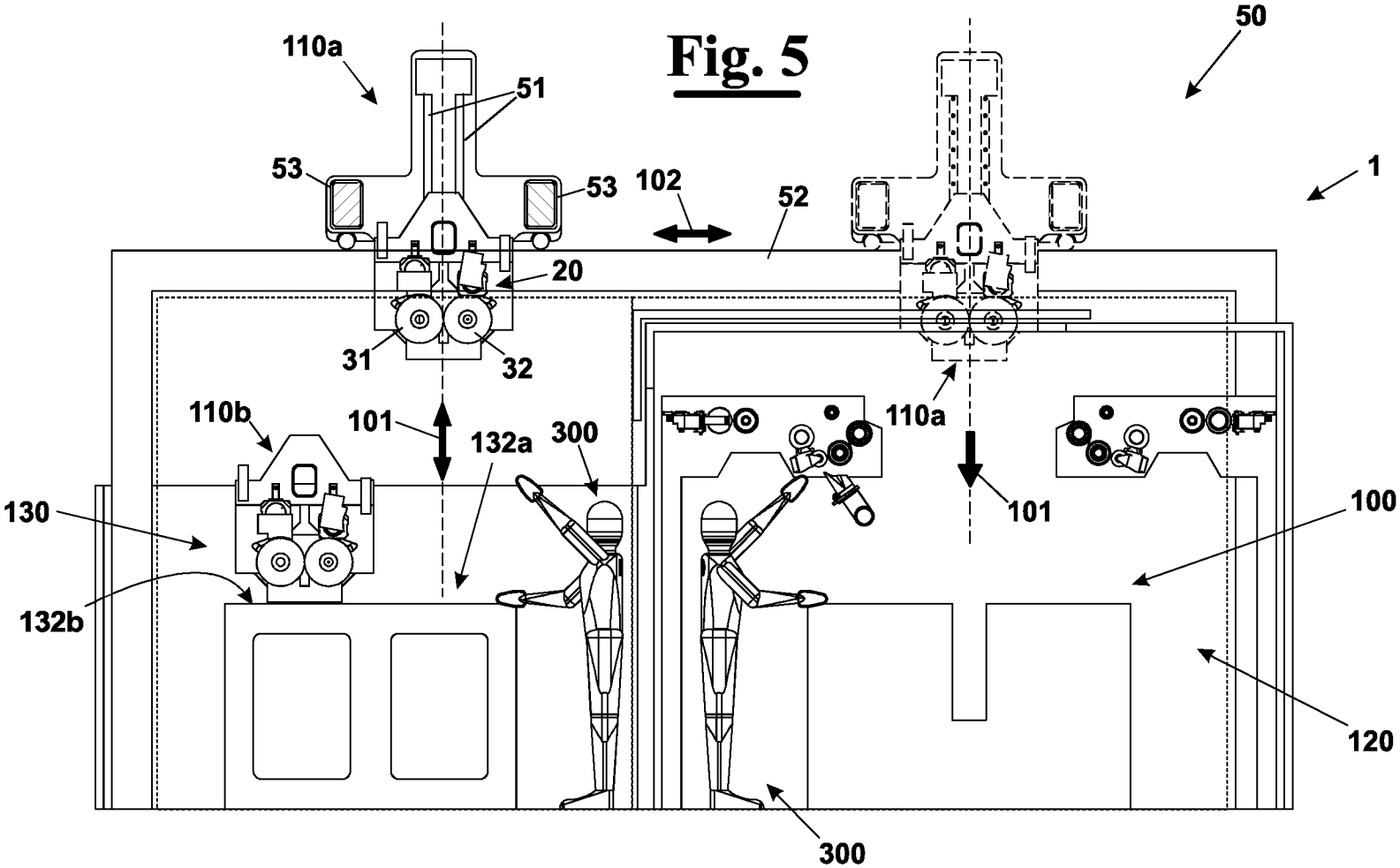
Figure 6:
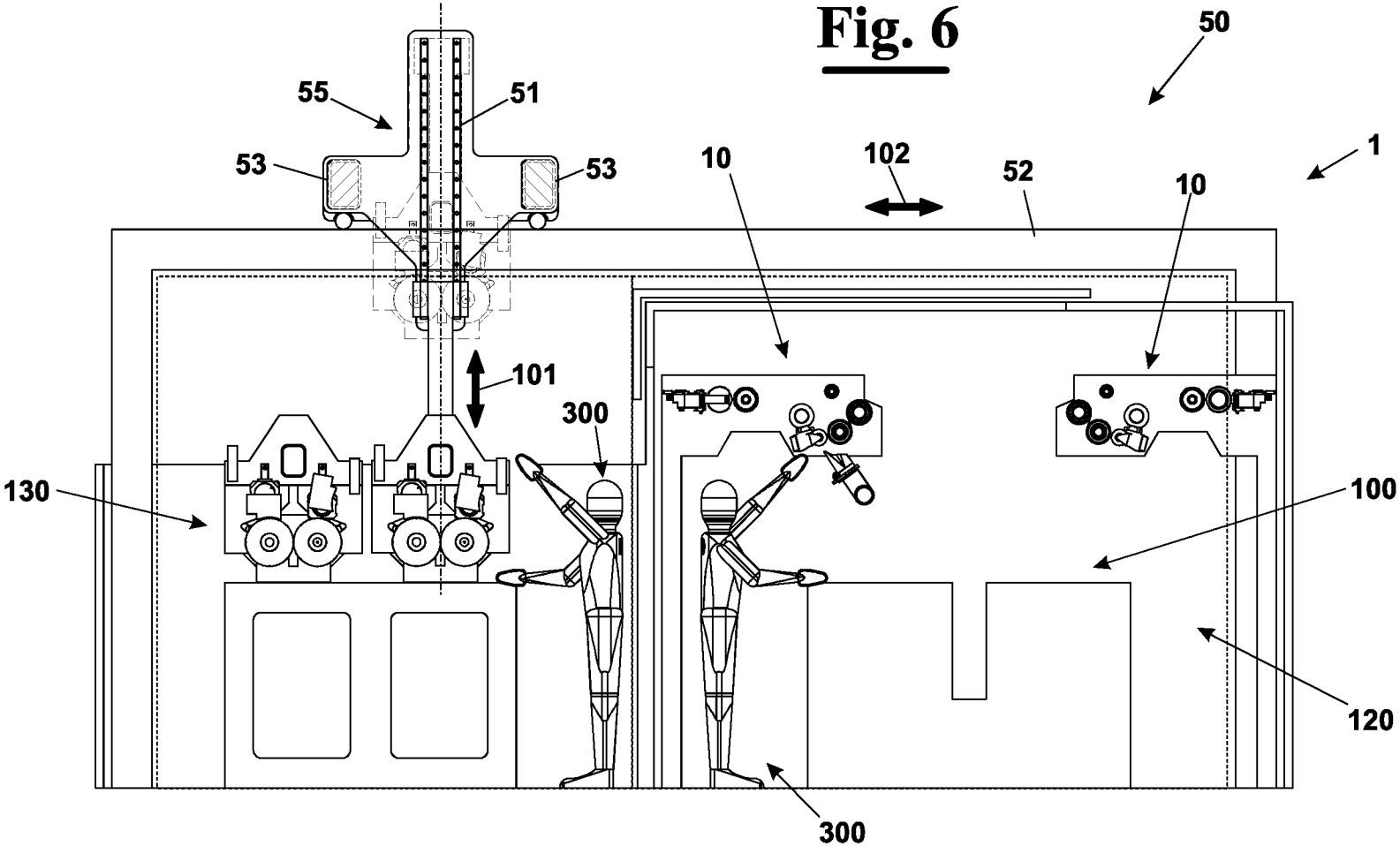
Figure 7:
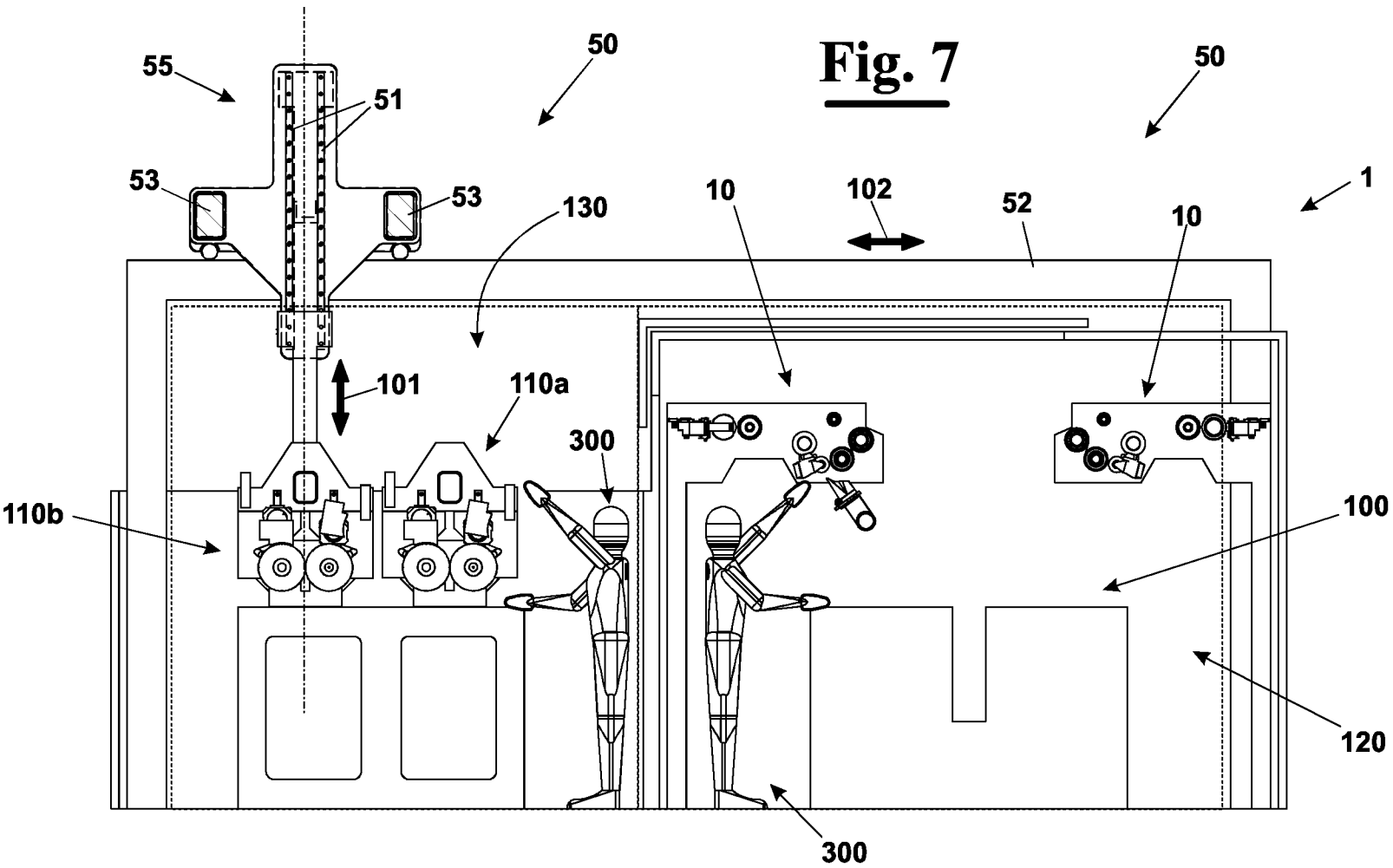
Figure 8:
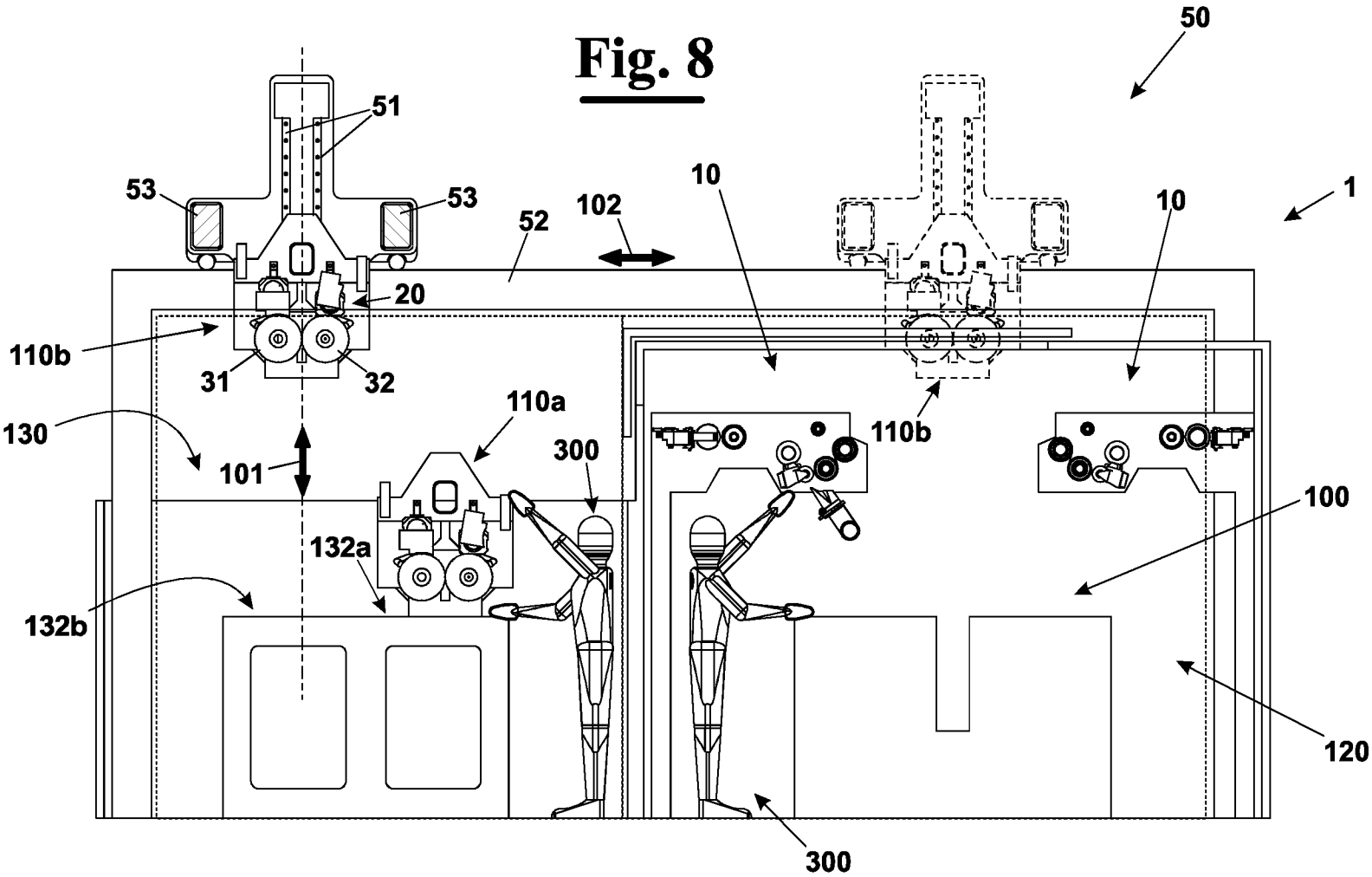
Figure 9:
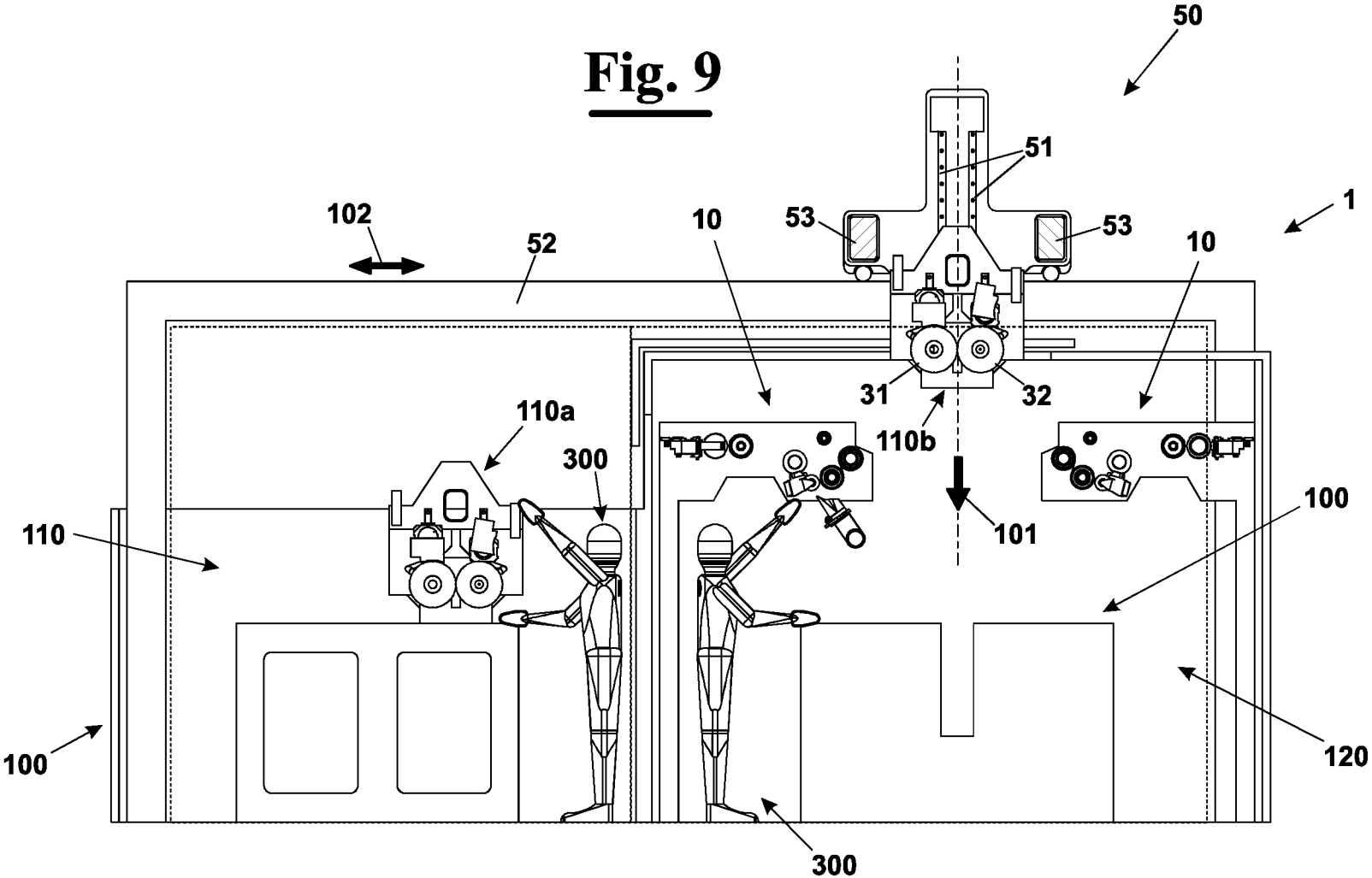
Figure 10:
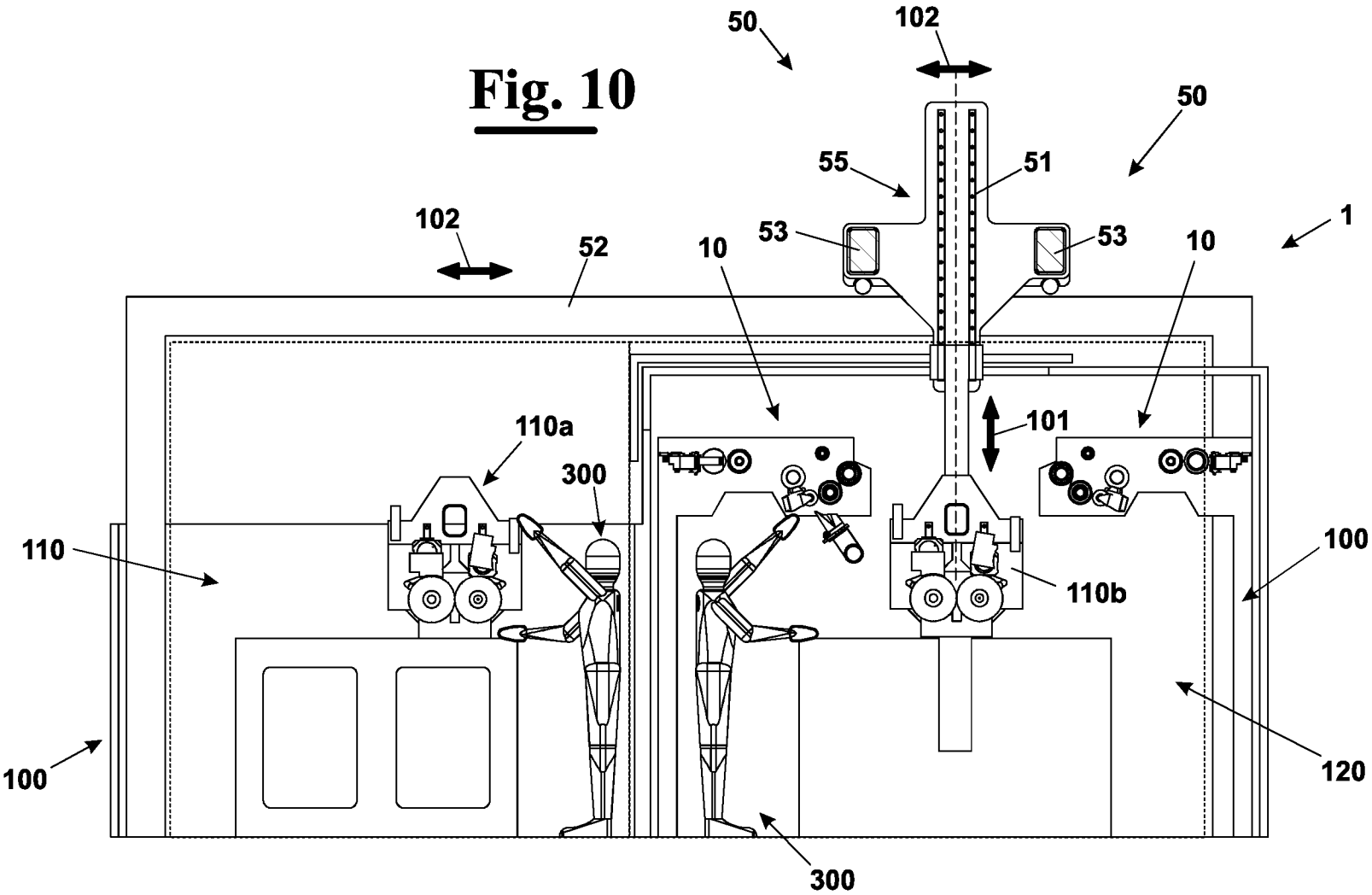

As diagrammatically shown for example in the FIGS. 1 and 2, for the two types of cutting group 20 described above, in a possible embodiment of the invention, the displacement group 50 can provide a first guide member 51 oriented along the first displacement direction 101, and, advantageously, a second guide member 52 oriented along a second displacement direction orthogonal to the aforementioned first displacement direction 101. In particular, the first guide member 51 can be mounted on a support member 55. This latter can be configured to slide along the second guide member 52. In particular, the support member 55 can comprise a base portion 56 and a sliding portion 57 configured to slide with respect to the base portion 56 along the aforementioned first guide member 51. More in particular, the sliding portion 57 can be provided with the engagement portion 58 configured to engage the respective engagement portion 118 of the support body 110.

In the example that is diagrammatically shown in the FIGS. 11 to 14, the displacement group 50 provides a first and a second support member 55 provided with respective engagement portions 58 adapted to engage respective engagement portions 118 at opposite ends 116 and 117. For example, the or each engagement portion 58 can be a shelf protruding from the sliding portion 57 and the or each engagement portion 118 of the support body 110 can be a portion which protrudes longitudinally to the support body 110. In this way, in order to lift the support body 110, it is possible to position the engagement portion 58 below the engagement portion 118 and, then, to move upward the sliding portion 57 along the first displacement direction 101. In other embodiments, the sliding portion 57 can be provided with different engagement devices arranged to hook or engage the support body 110 to lift and to displace the same from and towards a store area 130, such as, for example, devices for providing a magnetic coupling, for example electromagnets, or a mechanical coupling.

In some embodiments, the support member 55 can be configured to slide with respect to a third guide member 53 along a third displacement direction 103 orthogonal to the first and to the second displacement direction 101 and 102. In this way, it is possible to approach or move away the engagement portions 58 and 118 with respect to each other to cause them to move from the disengagement position shown in the FIGS. 11 and 12, to the engagement position shown in the FIGS. 13 and 14, and vice versa. In general, the displacement group 50 can be a manipulator having at least two degrees of freedom. In preferred embodiments the two degrees of freedom are orthogonal to each other, but the possibility is also foreseen that the displacement group 50 can be configured to cause the movement of the support body 110 from the assembled position to the disassembled position, or vice versa, by a combination of movements comprising at least one translation and at least one rotation. For example, in a solution that is not shown in figure for simplicity, the support member 55 can be adapted to move along the second guide member 52 and to be provided with two swinging arms, i.e. rotatably mounted on support member 55 and able to engage the support body 110 to lift the same from the support frame 100.

Figure 11:
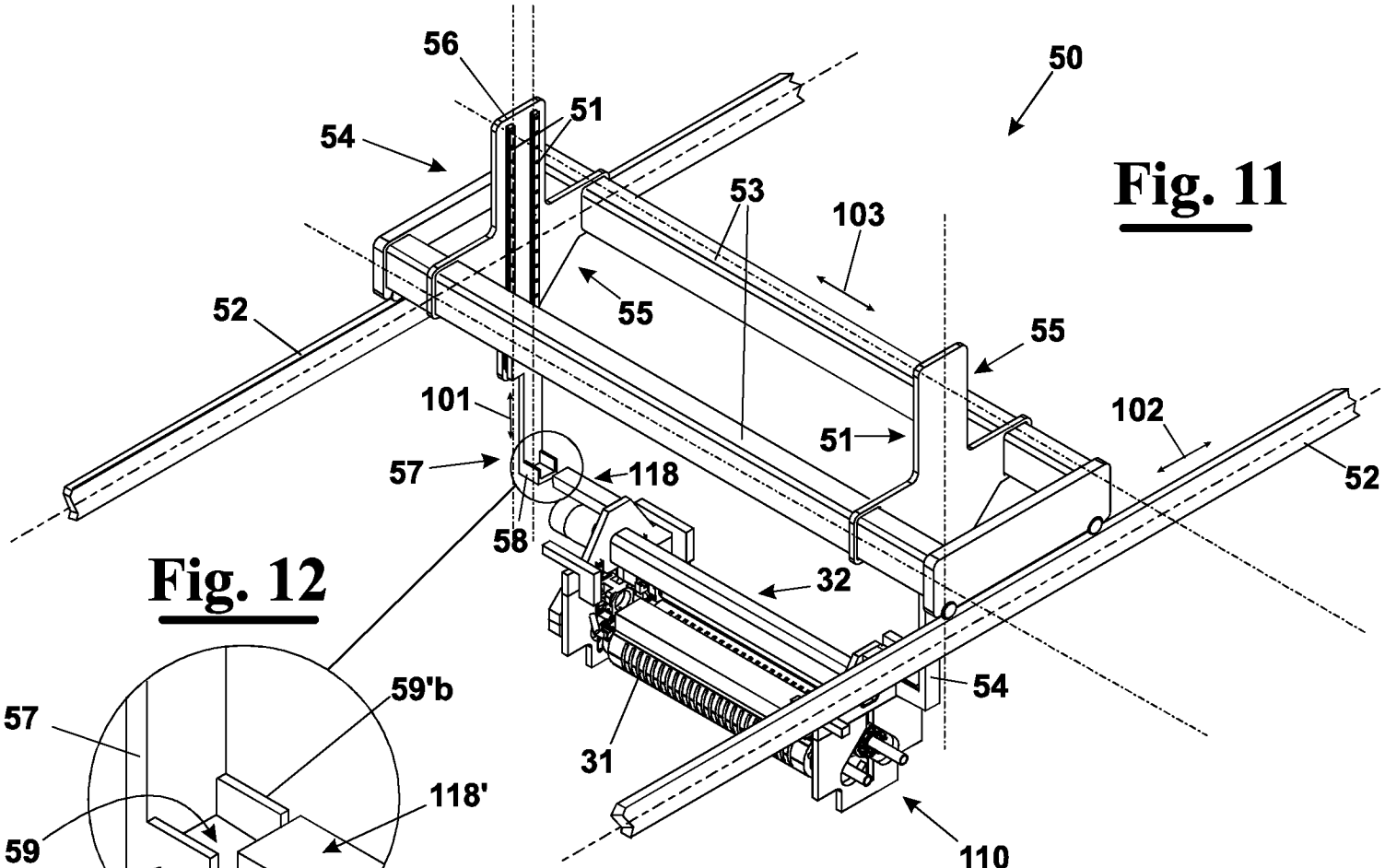
FIG. 11 diagrammatically shows a side elevation perspective view of the embodiment of the displacement group provided by the machine according to the invention and a support body in a relative disengagement position of the respective engagement portions.
Figure 12:
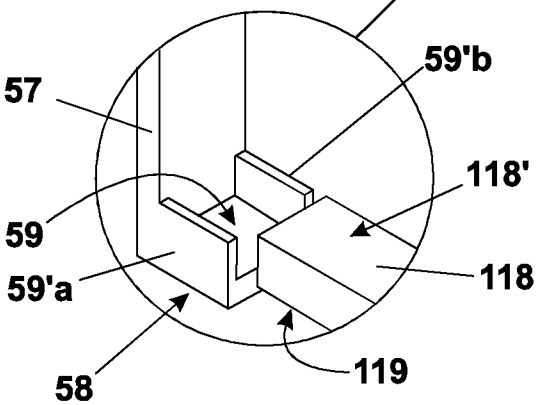
FIG. 12 diagrammatically shows an enlargement of the engagement portions of FIG. 11 to show some technical characteristics in the disengagement position.

As diagrammatically shown for example in FIG. 11 the support member 55 can be configured to move, in particular integrally to the third guide member 53, with respect to the second guide member 52. In this way, it is possible to move the support member 55 and, therefore, the support body 110 that is supported by it, between a working area 120 and a store area 130. More in particular, within the store area 130 at least a second support body 110*b* can be positioned that have different characteristics, in particular in terms of size, with respect to the folding or interfolding group 30 and to the cutting members 20, in particular folding rolls 31*b* and 32*b* having a diameter different from the folding rolls 31*a* and 32*a* of a first support body 110*a* positioned within the working area 120, i.e. in the assembled position with respect to the support frame 100.

In this way, if a production change is requested, for example in terms of length of the panel and/or the sheet 6, it is sufficient to operate the displacement group 50 in order to carry out the operations that are diagrammatically shown in the FIGS. 2 to 11 to remove the support body 110*a* arranged in the assembled position that means on the support frame 100, to its positioning, which is carried out again by the displacement group 50, inside the store area 130, to the picking up from the store area 130 of another support body, for example the support body 110*b*, and its positioning on the support frame 100 in the assembled position. In particular, within the store area 130 at least a free position can be provided at which the support body 110 picked up at the assembled position can be positioned. According to the present invention, the store area 130 and the working area 120 can be approached by at least one worker 300, advantageously through independent accesses 135 and 125, respectively. In this way, it is possible for the worker 300 to easily and quickly reach the aforementioned areas and any support body 110 that is in case positioned there in order to carry out ordinary or extraordinary maintenance operations. In particular, whilst the paper converting line comprising the machine 1 is normally working, a worker can enter the store area 130 to carry out the maintenance operations on the support bodies 110 comprising the folding or interfolding group 30 and, if present, the cutting group 20.

In particular, the displacement group 50 can be configured to alternately and selectively bring a first support body 110*a* in the disassembled position from the assembled position, and a second support body 110*b* from the disassembled position in the assembled position.

As diagrammatically shown in FIG. 20, each of the folding or interfolding rolls 31 and 32 can comprise a tubular body 33 configured to rotate about a respective longitudinal rotation axis 131 and 132. The tubular body 33 is provided with a plurality of suction holes 34 organized in a plurality of couples of longitudinal rows close to each other. A vacuum distribution device 38 can be, furthermore, provided that will not be described here in detail, but, for example, of the type that is described in EP1457444 or WO2020161571, both in the name of the present Applicant. In particular, the vacuum distribution device 38 is configured to selectively pneumatically connect at least a vacuum generation device 250 to at least a row at a time of the aforementioned plurality of rows of suction holes 34, at predetermined angular positions of the tubular body 33, in such a way to cause the worked sheets of paper 6 to be sucked and to adhere at predetermined portions of the folding or interfolding roll 31 or 32.

According to the present invention, the vacuum distribution device and the or each vacuum generation device 250 are pneumatically connected to each other by a connection duct 70. This, as diagrammatically shown in FIG. 20, can comprise a first portion 71 integral to the vacuum distribution device 250 and a second portion 72, in particular a second portion 72 associated to each folding or interfolding roll 31 and 32, integral to the vacuum generation device 38.

Figure 21:
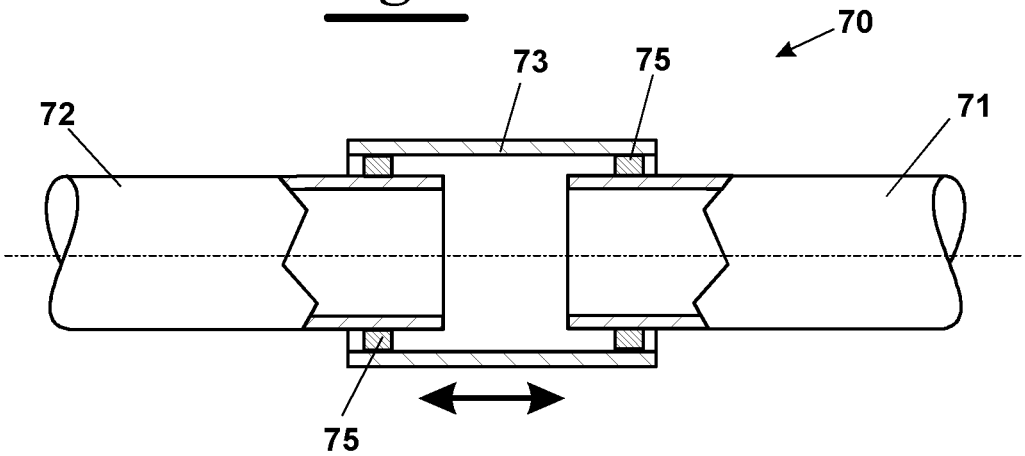
FIGS. 21 to 23 diagrammatically show some working configurations of a connection duct provided by the present invention.
Figure 22:
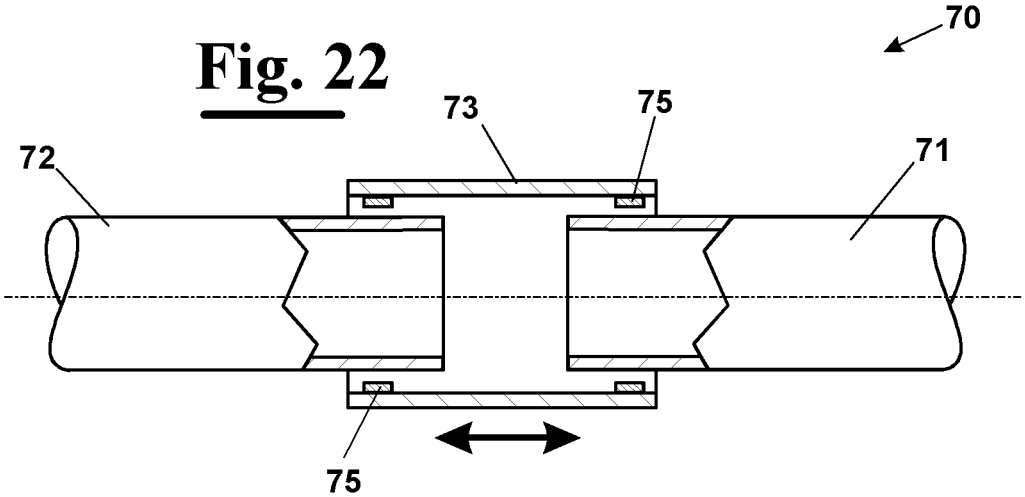
Figure 23:
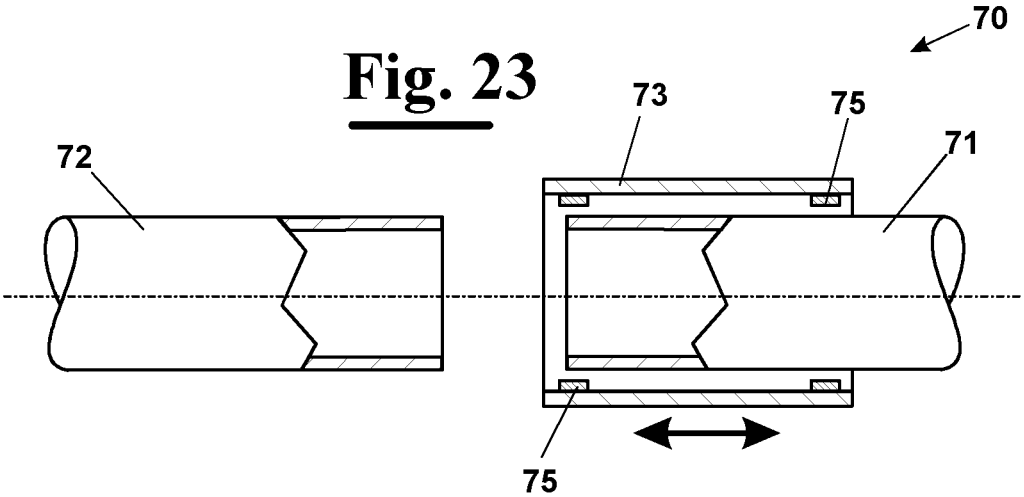

In particular, as diagrammatically shown in the FIGS. 21 to 23, the first and second portions 71 and 72 can be adapted to move between a connection configuration (FIG. 21), in which are adapted to pneumatically connect the vacuum generation device 250 to the vacuum distribution device 38, and a disconnection configuration (FIG. 23), in which are adapted to pneumatically disconnect the vacuum distribution device 250 and the vacuum generation device 38. More in particular, the connection duct 70 can, furthermore, comprise a third portion 73 configured to move from connection position (FIG. 21) in which is adapted to pneumatically connect the first and the second portion of the connection duct 71 and 72 to each other that are, therefore, arranged in the connection configuration, and a disconnection position in which is adapted to pneumatically disconnect the first and second connection portions 71 and 72, which are, therefore, arranged in the aforementioned disconnection configuration.

As diagrammatically shown in the FIGS. 21 to 23, the third portion 73 can be slidingly mounted with respect to the first and second portions 71 and 72 of the connection duct 70 between the connection position, where is arranged in an advanced position, and the disconnection position, where is arranged in a retracted position. More in detail, at least one sealing element 75, for example an O-ring, positioned between the third portion 73 and the first and/or the second portion 71 and/or 72.

In particular, the or each sealing element 75 can be configured to move from a working configuration, in which is adapted to exert a sealing action to pneumatically isolate the first and second portions 71 and 72 of the connection duct 70 from the external environment (FIG. 21), and a rest configuration in which is not adapted to exert the aforementioned sealing action (FIGS. 22 and 23). For example, the or each sealing element 75 can be pneumatically connected to an inflating device, which is not shown in figure for simplicity, adapted to cause the movement from the rest configuration to the working configuration, in particular by introducing air, or another gas, into each sealing element. In particular, in an embodiment provided by the invention, it is possible to cause the third portion 73 to slide from the connection position to the disconnection position and vice versa, when the or each sealing element 75 is in the rest configuration. More in particular, when the or each sealing element 75 is arranged in the working configuration, it can be adapted to prevent, or obstruct, the third portion 73 from sliding.

Figure 24:
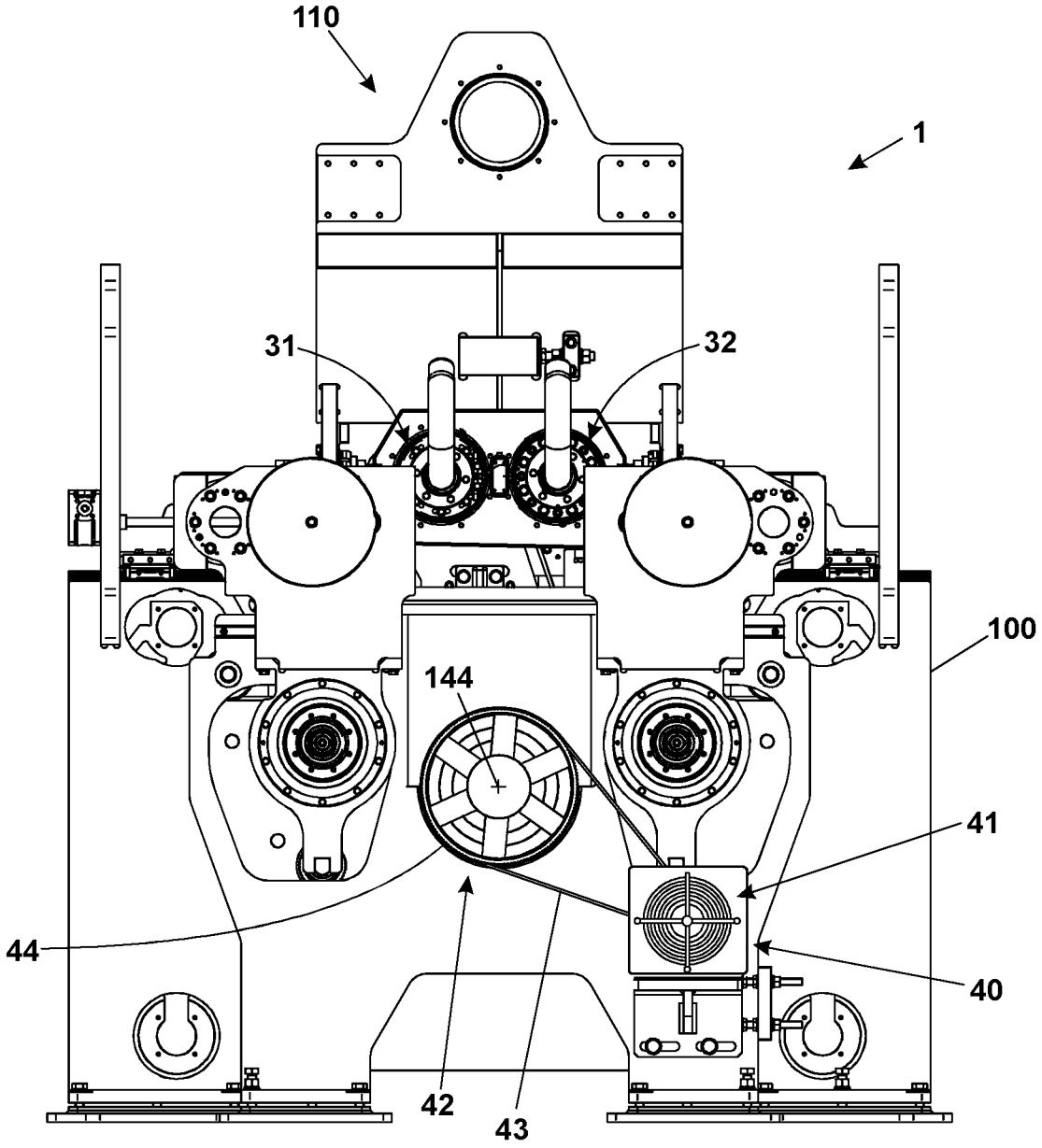
FIG. 24 diagrammatically shows a front view of the machine according to the invention.

Advantageously, as diagrammatically shown in FIG. 24, the machine 1 comprises, furthermore, a motor group 40 configured to cause at least one between the first and second folding or interfolding rolls 31 and 32 to rotate about the respective rotation axis 131 and 132. In particular, the motor group 40 can be configured to operate the aforementioned rotation by a main motor 41 and a motion transmission device 42 configured to transmit the rotational motion of the rotation shaft, which is not shown in figure for simplicity, of the main motor 41 to at least one between the first and second folding or interfolding rolls 31 and 32.

In particular, the motion transmission device 42 can comprise a first transmission member 43, for example a first toothed belt 43. As diagrammatically shown in the FIGS. 24 and 25, the first transmission member 43 can mesh with a main deflection wheel 44 in such a way to cause to rotate about a rotation axis 144. In particular, the motion transmission device 42 can comprise, furthermore, a rotation shaft 145 coaxially arranged to the main deflection wheel 44 and integral to it. Therefore, the aforementioned rotational motion of the main deflection wheel 44 causes also the rotation shaft 145 to rotate about the rotation axis 144. More in particular, the motion transmission device 42 can comprise, furthermore, at least a second motion transmission member, for example a second toothed belt 45, which is mounted on the aforementioned rotation shaft 145 and on a series of guide pulleys 46 defining a predetermined sliding path. More in detail, the second motion transmission member 45, is adapted to mesh with a motion transmission portion 37 integral to the first, or second folding or interfolding roll, 31 or 32, in such a way to cause a rotation about the respective longitudinal rotation axis 131 or 132. Preferably, the first and second folding or interfolding rolls 31 and 32 can be operatively connected with each other by respective gears, for example toothed wheels coaxially arranged to the rolls 31 and 32 and that are not shown in the figure for simplicity, in such a way that the rotations of the same about the respective rotation axes 131 and 132 are synchronized and occur in directions of rotation opposite to each other.

Advantageously, a group for adjusting the tension 60 is, furthermore, provided configured to adjust the tension of the motion transmission device 42, in particular the tension acting on the first and/or on the second motion transmission member 43 and/or 45.

In particular, the group for adjusting the tension 60 can be configured to keep constant, or substantially constant, the tension of the motion transmission device 42, preferably of the second transmission member 45, in particular during the movement of the support body 110 between the assembled position and the disassembled position carried out by the displacement group 50. In this way, it is possible to ensure that during the replacement of a support body 110, for example of the support body 110*a* with the support body 110*b*, the second motion transmission member 45, in particular the toothed belt, is correctly positioned with respect to the different movable parts remaining on the support frame 100. Therefore, it is ensured that the different parts of the machine 1 are able to correctly work when the machine 1 is operated again and arranged in working conditions.

In an alternative embodiment not shown in the figure for simplicity, the transmission of the motion of the motor shaft of the main motor 41 to the rotation shaft 145 can be obtained by using as motor shaft 145 the motor shaft of the main motor 41, i.e. mounting the same coaxially to the rotation axis 144.

In an embodiment of the invention, the group for adjusting the tension 60 comprises a measurement device 63, for example a force sensor, such as a load cell, advantageously configured to measure the tension on the second motion transmission member 45.

In particular, the measurement device 63 can be operatively connected to a processing device 200 configured to operate an actuation device 65. More in particular, the actuation device 65 can be configured to cause a lengthening or a shortening of the path of the motion transmission member 45 depending on the tension signal detected by the aforementioned measurement device 63. More in detail, the motion transmission belt 45 can be mounted on a series of guide pulleys or rollers 46 and 47 at least one of which able to move along a predetermined direction. For example, the transmission belt 45 can be mounted on a series of fixed guide pulleys 46 and on at least one movable guide pulley 47, for example on two movable guide pulleys 47. In particular, the actuation device 65 can be arranged to lengthen or to shorten the path of the transmission belt 45 thus causing the or each movable guide pulley 47 to move away from the fixed guide pulleys 46. As diagrammatically shown in the FIGS. 24 and 25, the actuation device 65 can comprise a motor 61 configured to cause the or each movable guide pulley 47 to move along a predetermined actuation direction 162 by an actuation device 65. In practice, during the replacement of a support body 110, the tension of the transmission belt 45 tends to gradually reduce that the aforementioned support body 110 is lifted and, therefore, progressively disengaged from the transmission belt 45. During this step, the group for adjusting the tension 60 can be operated by the processing device 200 to keep the tension of the transmission belt 45 constant or substantially constant, by operating the actuation device 65. Analogously, the tension of the transmission belt 45 tends to increase during the positioning of a new support body 110 which engages with the motion transmission portion 37 of one between the folding or interfolding rolls 31 and 32. Also in this step the group for adjusting the tension 60 can be operated by the processing device 200 to keep constant the tension of the transmission belt 45.

Advantageously, the tension adjustment device 60 can be used also during the normal working conditions of the machine 1 to keep the transmission belt 45 constantly at a determined correct working tension. In this way both overloads and loosening, which could cause the loss of phase between the folding rolls 31 and 32 with other components of the machine 1 exposing to the risk of jamming, are avoided, or malfunctions in general that in the worst cases can cause the machine 1 to be damaged.

Figure 27:
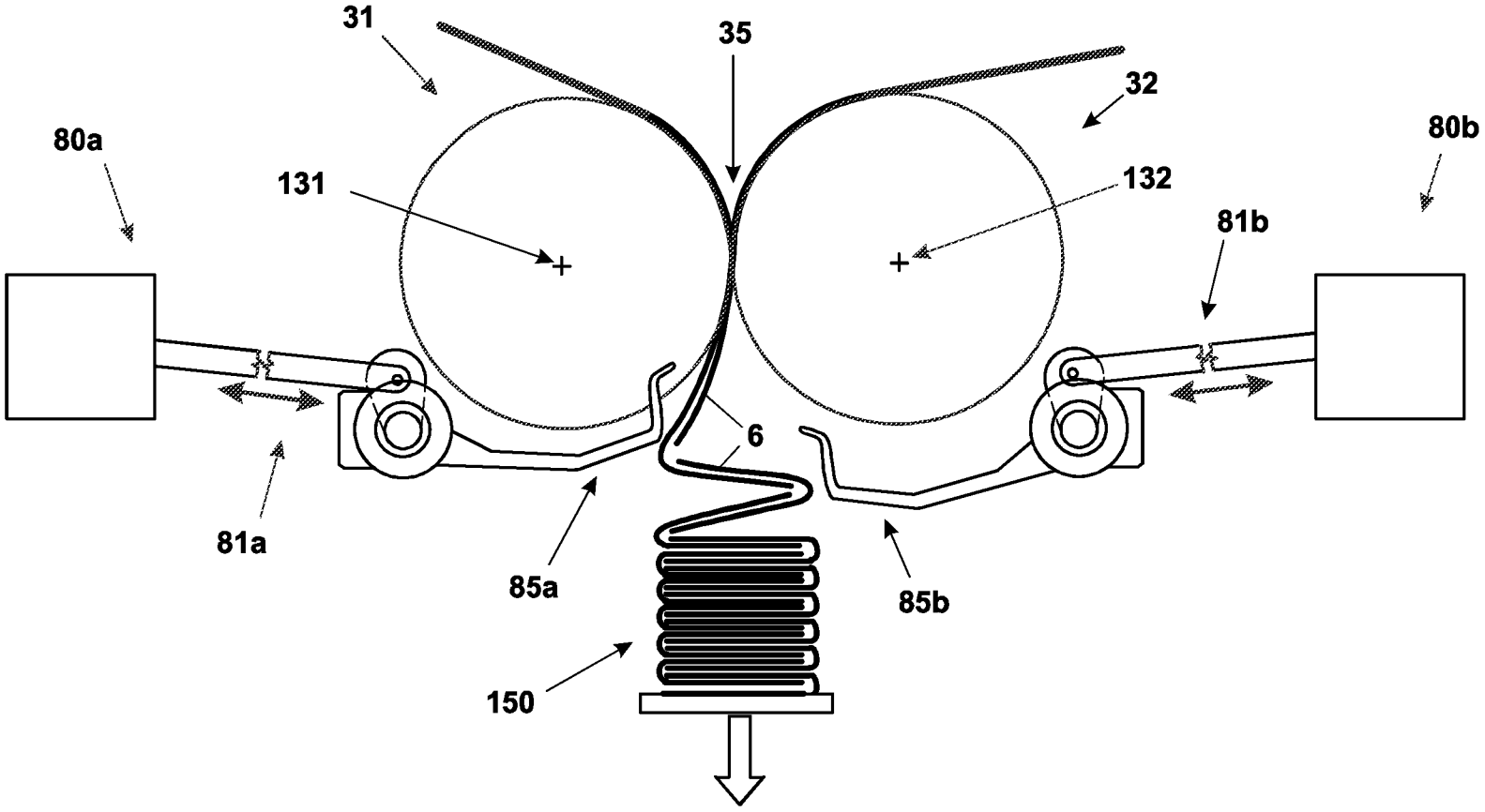
FIGS. 27 and 28 diagrammatically show two possible embodiments of the driving group of the detaching fingers which can be adopted by the machine according to the invention.

As diagrammatically shown in FIG. 27, the machine 1 according to the invention, can comprise, furthermore, a first and a second plurality of detaching fingers 85*a* and 85*b* configured to cause respectively the detachment of the folded or interfolded sheets of paper 6, from the first and second folding or interfolding roll 31 and 32, in particular from their external lateral surface.

In particular, a first and a second driving group 80*a* and 80*b* are provided configured, respectively, to cause a oscillatory back and forth motion of the first and second pluralities of detaching fingers 85*a* and 85*b* towards the or from the folding or interfolding zone 35, in such a way to cause the e detachment of the sheets of paper 6, respectively, from the first and second folding or interfolding roll 31 and 32. More in particular, the first and second driving groups 80*a* and 80*b* can be configured to convert the rotational motion of a motor, or of respective motor, in an oscillatory back and forth motion that is transmitted to the first and second pluralities of detaching fingers 85*a* and 85*b*. In some preferred embodiments of the invention, a transmission device can be provided operated by a main motor 41, not shown in the figure, configured to cause the first and second driving groups 80*a* and 80*b* to rotate and that is, therefore, converted in an oscillatory motion.

Advantageously, the first and second driving groups 80*a* and 80*b* can be configured to bring, respectively, the first and second pluralities of detaching fingers 85*a* and 85*b* in a predetermined reference position, preferably corresponding to the position of top dead centre of the detaching fingers 85*a* and 85*b* during the respective back and forth motion. In particular, the reference position can be a position where the detaching fingers 85*a* and 85*b* do not have mechanical interference with other components of machine 1, in particular with the folding or interfolding rolls 31 and 32 and with the cutting blades 36. Advantageously, the first and second driving groups 80*a* and 80*b* are arranged to move, respectively, the first and second pluralities of detaching fingers 85*a* and 85*b* in the reference position before that the displacement group 50 is arranged to move the support body 110 between the assembled position and the disassembled position. In this way, it is ensured that, at the moment of positioning a new support body 110 on the support frame 100, no interference occurs between the different parts of the machine 1, which remain on the support frame 100 and the parts that are mounted on the support body 110, in particular between the detaching fingers 85*a* and 85*b* and the cutting blades 36 distributed along the folding or interfolding rolls 31 and 32, in the case that the cutting group 20 is of the type described above with reference to FIG. 2.

In particular, according to the present invention, the first and second driving groups 80*a* and 80*b* can be configured to delay or anticipate the oscillatory motion of the first and second pluralities of detaching fingers 85*a* and 85*b* with respect to a predetermined reference oscillatory motion. In this way, it is possible to delay or anticipate the instant (tr) at which the first and second pluralities of detaching fingers 85*a* and 85*b* are arranged to cause the detachment of the sheets of paper 6 folded or interfolded, respectively from the first and the second folding or interfolding roll 31 and 32. This particular technical solution allows to adjust the motion of the detaching fingers 85*a* and 85*b* on the basis of the type of support body 110 installed in the machine 1, in particular of the diameter of the folding or interfolding rolls 31 and 32, of the number of blades 36 of which they are, in case, provided with, and of the other parameters of the cutting group 20 and/or of the folding or interfolding group 30 installed on the support body 110 arranged in the assembled position.

Figure 28:
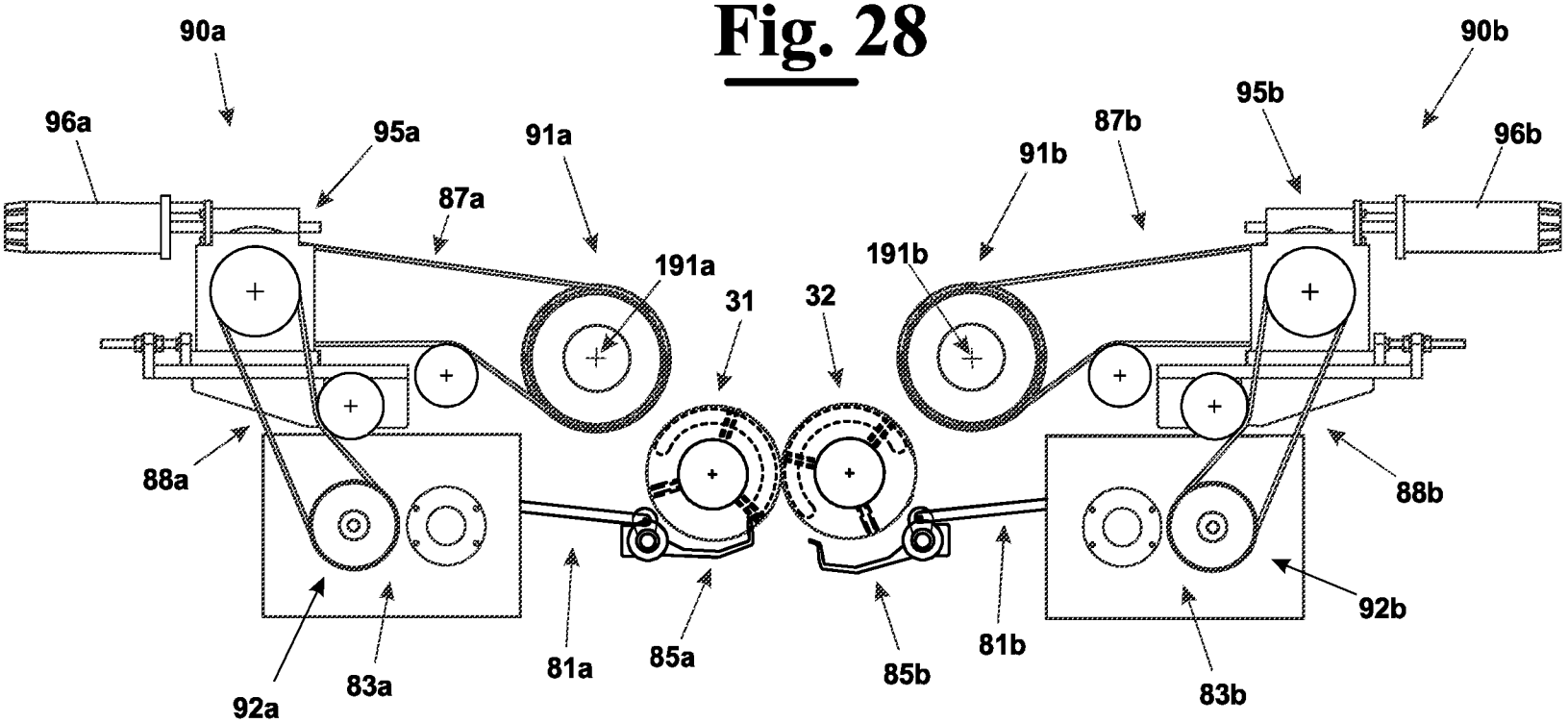

In the embodiment diagrammatically shown in FIG. 28, the first and second driving groups 80*a* and 80*b* can be, advantageously, associated, respectively, to a first and a second phase adjustment device 90*a* and 90*b* configured to adjust the phase of the first and second pluralities of detaching fingers 85*a* and 85*b* with the respective folding or interfolding rolls 31 and 32. In particular, the first and the second phase adjustment device 90*a* and 90*b* are adapted to anticipate, or postpone, the instant tr at which the first and second pluralities of detaching fingers 85*a*, 85*b* are adapted to hit the web or sheet of paper to cause it to be detached from the respective folding or interfolding roll 31 and 32.

Advantageously, the first and second phase adjustment devices 90*a* and 90*b* can comprise, respectively, a first and a second epicycloidal gear 95*a*, and 95*b*. More precisely, in this case, the first and second epicycloidal gear 95*a* and 95*b* can be operatively connected respectively to a first and a second motor group 91*a* and 91*b*, for example by a first transmission belt 87*a*, and 87*b*, and to a first and a second driving device 92*a* and 92*b* by a second transmission belt 88*a* and 88*b*. More precisely, the first and second driving device 92*a* and 92*b* are adapted to transmit the rotational motion generated by the first and second motor groups 91*a* and 91*b*, respectively to the first and to the second driving group 80*a* and 80*b*. The first and second epicycloidal gears 95*a* and 95*b* are, respectively, provided with a first and a second electric motor 96*a* and 96*b*. These are adapted to adjust the velocity of rotation of the first and of the second driving device 92*a* and 92*b* adjusting the velocity and the direction of rotation of a first and of a second epicycloidal gear, not shown in the figure for simplicity, housed, respectively, within the first and the second epicycloidal gear 95*a* and 95*b*.

According to a possible functioning mode provided by the invention, the first and second electric motors 96*a* and 96*b* can be normally still in such a way not to change the phase of the detaching fingers 85*a* and 85*b* with respect to the other parts of the machine 1, in particular the folding rolls 31 and 32. If it is necessary to change the phase of the first and of the second plurality of detaching fingers 85*a* and 85*b*, for example as a consequence of the replacement of a support body 110 with another, the first and the second electric motors 96*a* and 96*b* are operated to actuate, respectively, the first and second epicycloidal gears in such a way to temporarily accelerate or decelerate the second transmission belt 88*a* and 88*b*. In this way, it is possible to introduce a delay, or an advance, in the oscillatory motion of the first and second pluralities of detaching fingers 85*a* and 85*b* and, therefore, to postpone, or anticipate, the instant at which the web or sheet of paper is released by the respective folding or interfolding roll 31 and 32, i.e. the instant tr at which the first and second pluralities of detaching fingers 85*a* and 85*b* are adapted to cause the web or sheet of paper 6 to be detached from the respective folding or interfolding roll 31 and 32, in particular with respect to a reference detaching instant tr*. In particular, maintaining still the first and the second motor group 91*a* and 91*b* and operating the first and the second electric motor 96*a* and 96*b*, it is possible to move the detaching fingers 85*a* and 85*b* with respect to the respective folding or interfolding rolls 31 and 32. In this way when it is necessary to replace a support body 110 with another, it is possible to move the detaching fingers 85*a* and 85*b* in the reference position maintaining the folding or interfolding rolls 31 and 32 still. Once that the reference position has been reached, it is possible to start the replacement of the support body 110.

Figure 25:
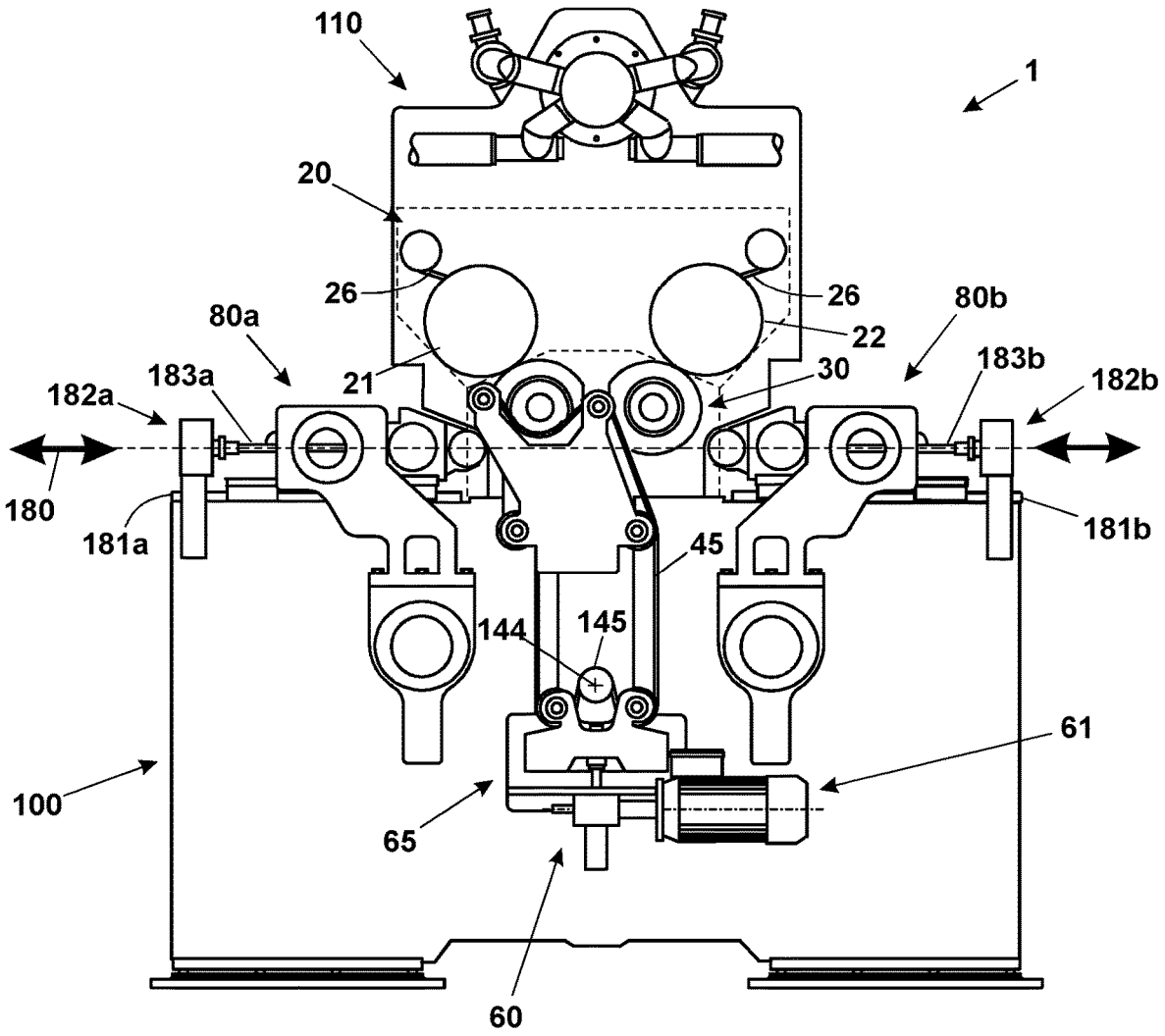
FIG. 25 diagrammatically shows the machine of FIG. 24 with some parts removed to highlight some technical characteristics.
Figure 26:
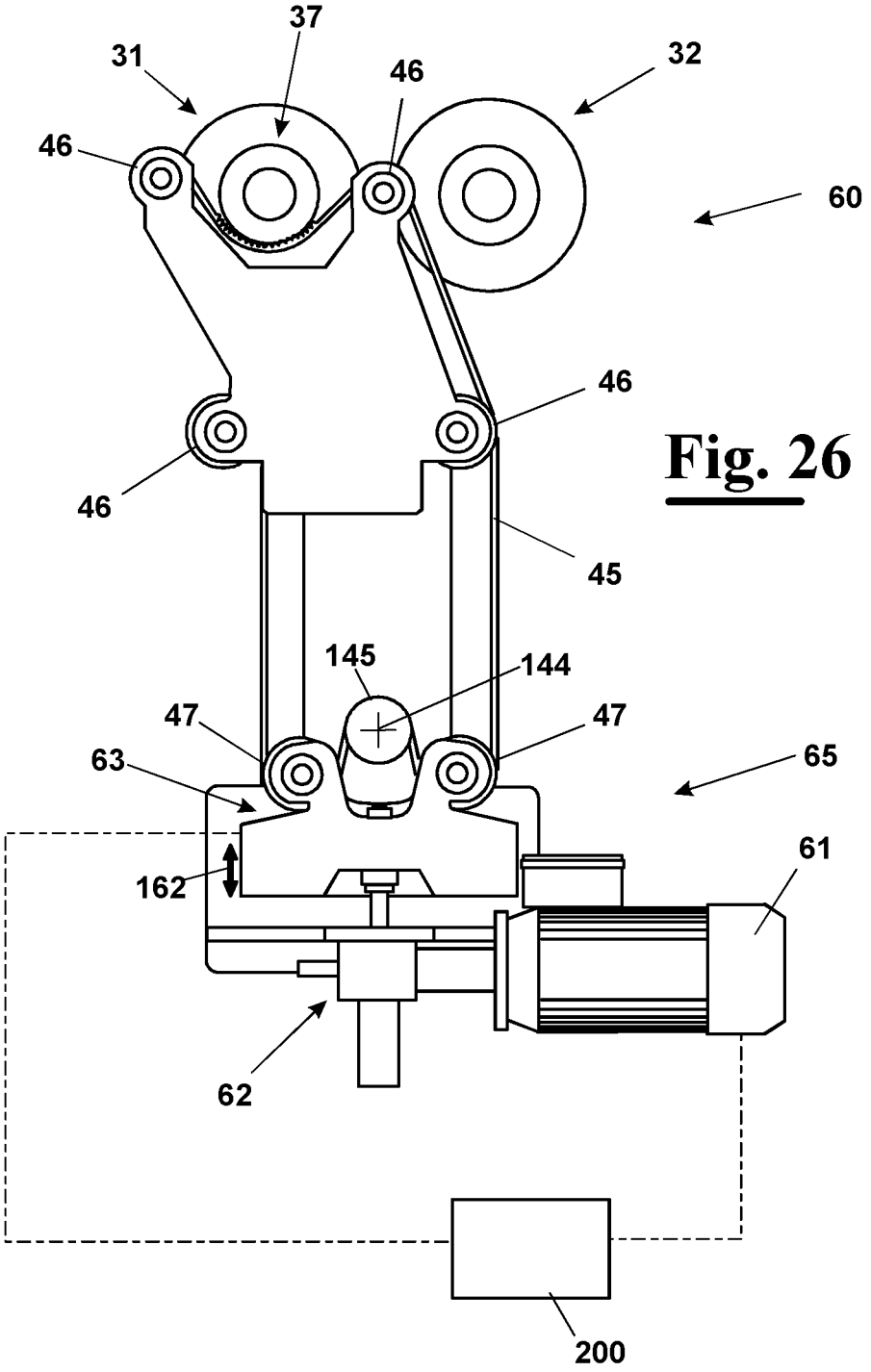
FIG. 26 diagrammatically shows an enlargement of some components of the machine of FIG. 25 to highlight some technical characteristics of the same.

In a possible embodiment of the invention that is diagrammatically shown in FIG. 25, the first and second driving groups 80*a* and 80*b* can be configured to translate one with respect to the other in order to approach or move away with respect to each other. In this way, it is possible to adjust the distance between them and in particular the distance with respect to the respective folding or interfolding rolls 31 and 32, in case that a support body 110 is replaced with another support body 110 equipped with folding or interfolding rolls 31 and 32 having a very different diameter with respect to the previous. In particular, the first and second driving groups 80*a* and 80*b* can be slidingly mounted along a predetermined sliding direction 180, in particular orthogonal to the axed 131 and 132 of the folding or interfolding rolls 31 and 32. More in particular, the first and second driving groups 80*a* and 80*b* can be mounted on a sliding group 185 configured to symmetrically approach or move away with respect to a plane of symmetry of the folding or interfolding rolls 31 and 32. For example, the first and second driving groups 80*a* and 80*b* can be mounted on a slide 181 arranged along the aforementioned sliding direction 180. In particular, a first and a second motor device 182*a* and 182*b* can be provided operatively connected, respectively, to the first and to the second driving group 80*a* and 80*b* by a respective connection member 183*a* and 183*b*. In this way, it is possible to approach or move away by the first and second connection members 183*a* and 183*b*, for example an actuation rod, the first and the second driving group 80*a* and 80*b* by operating, correspondingly, the first and second motor devices 182*a* and 182*b*. However, it is also possible that only one motor device 182 is provided configured to symmetrically move through a connection device 183 the first and second driving groups 80*a* and 80*b*.

In particular, according to a possible sequence of steps provided by the invention, at the moment of replacing a first support body 110*a* with a second support body 110*b*, a step of positioning the detaching fingers 85*a* and 85*b* in a reference position can be provided. The displacement group 50 can be, then, operated in such a way to engage the first support body 110*a* to be replaced at respective engagement portions 58 and 118.

Figures 13, 14:
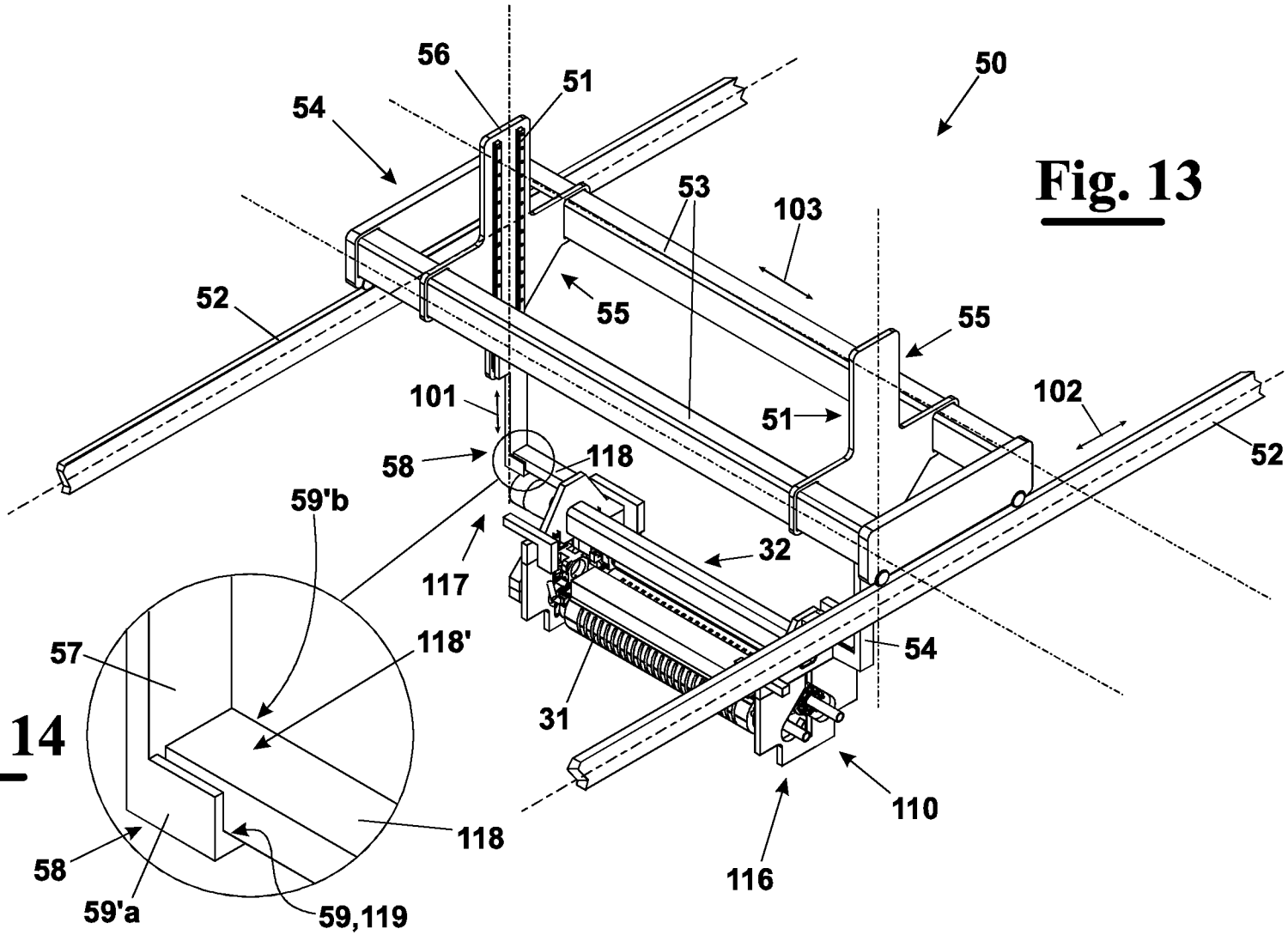
FIG. 13 shows a side elevation perspective view of the displacement group and of the support body of FIG. 11 in a relative engagement position of the respective engagement portions.
FIG. 14 shows an enlargement of the engagement portions of FIG. 13 to show some technical characteristics of the same in the engagement position.
Figure 15:
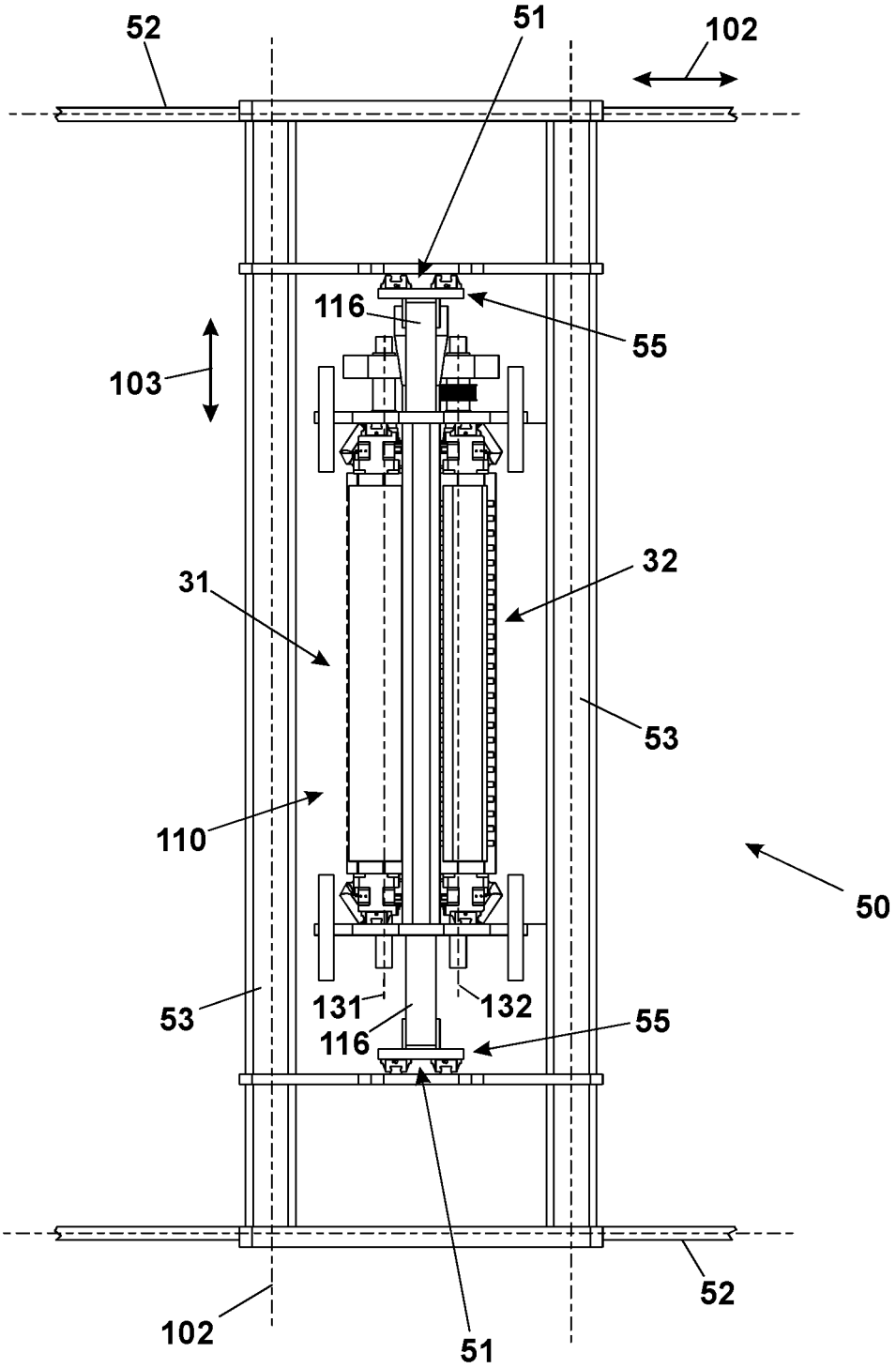
FIG. 15 diagrammatically shows a plan view of the displacement group and of the support body of FIG. 11.
Figure 16:
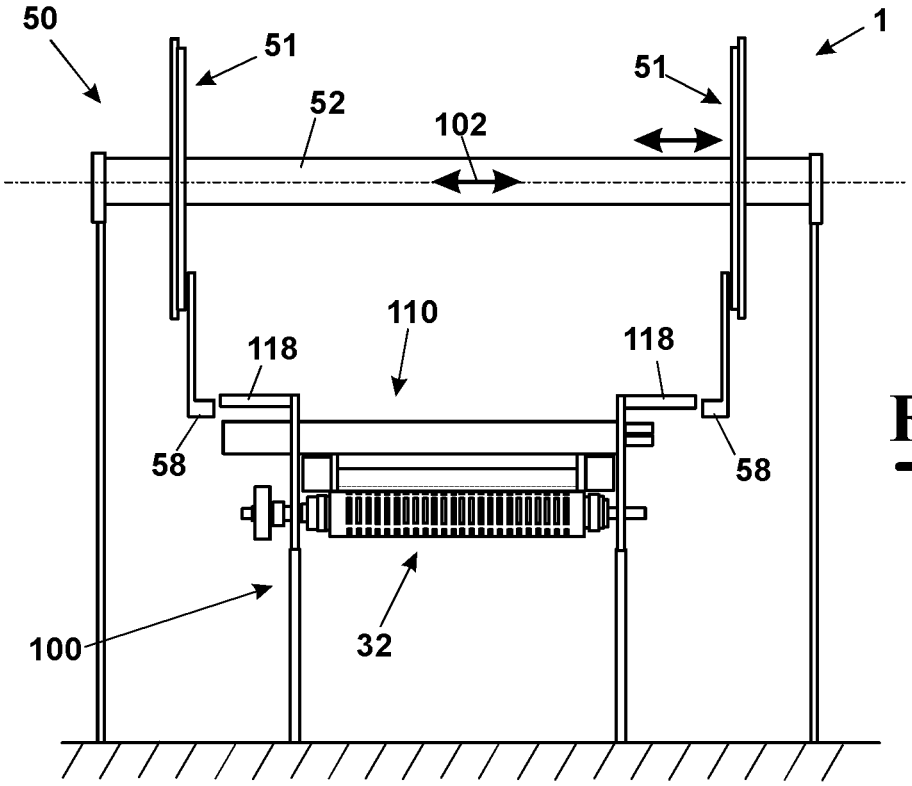
FIGS. 16 to 18 diagrammatically show a side elevation perspective view of some displacing steps of a support body carried out by the displacement group according to the invention.
Figure 17:
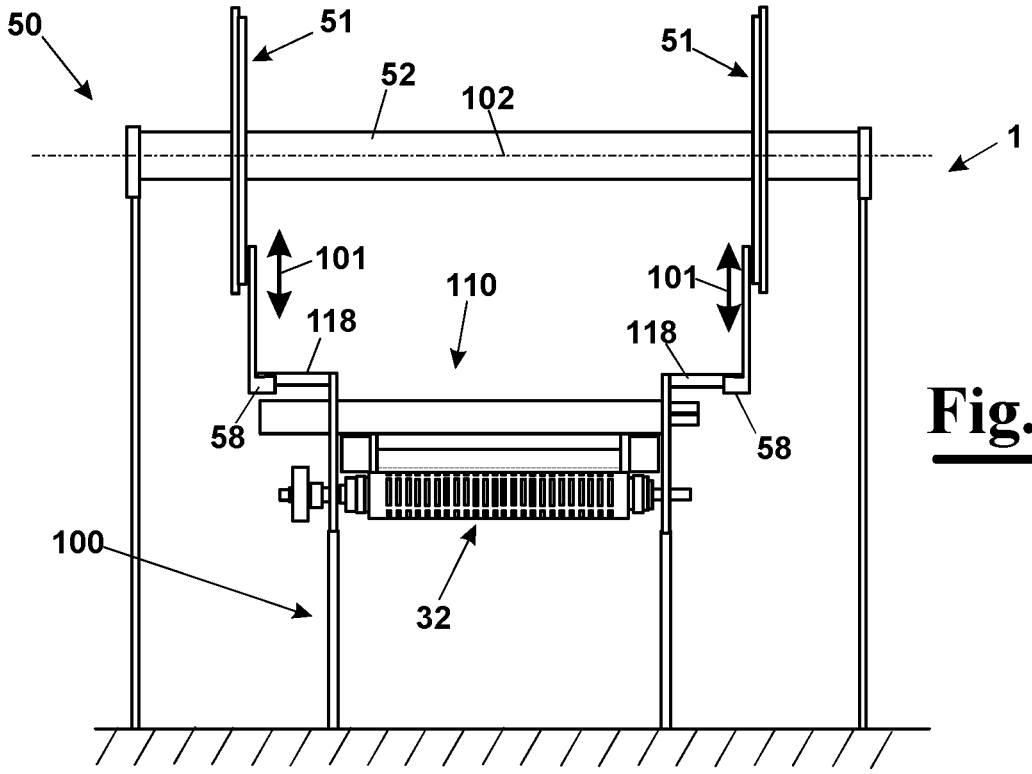
Figure 18:
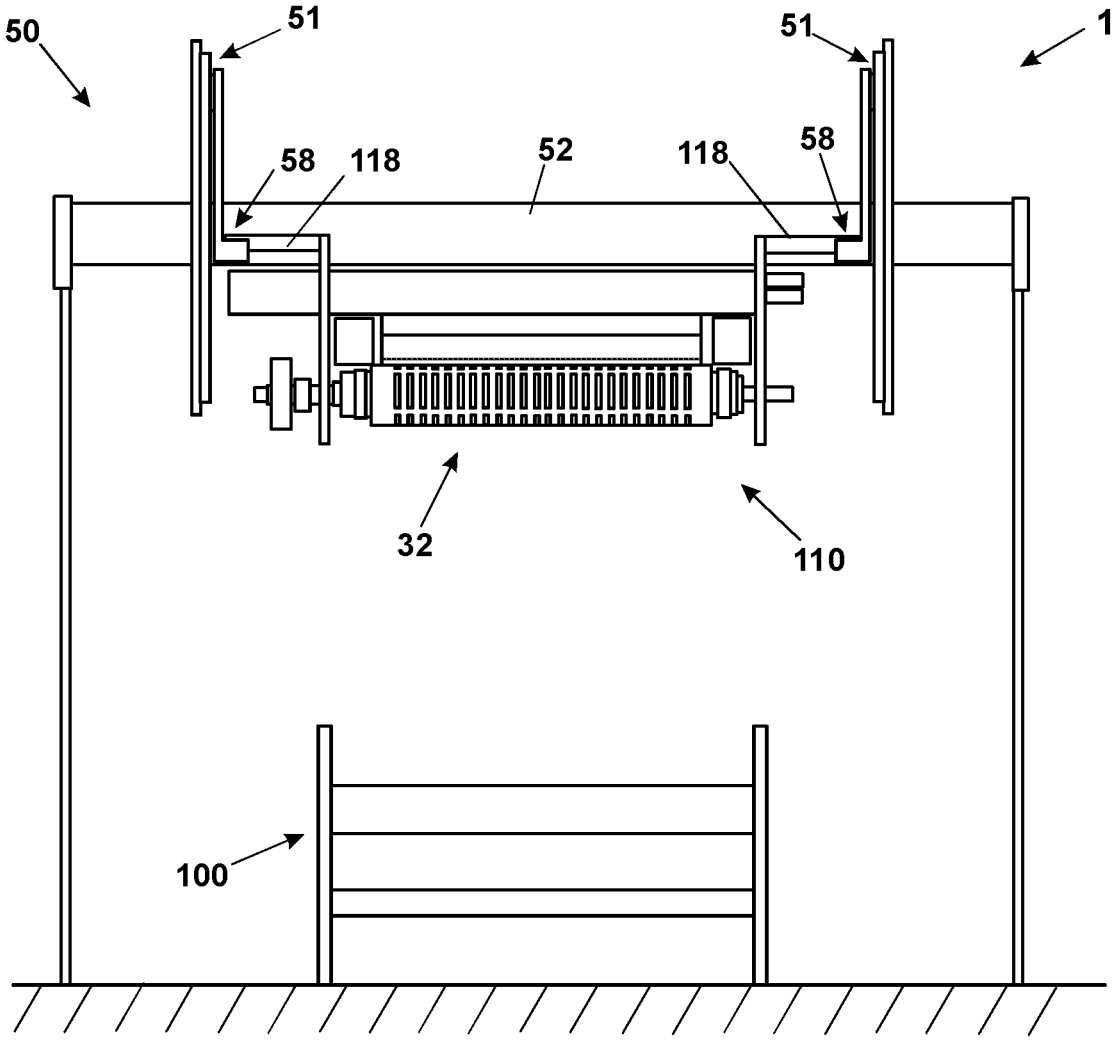
Figure 19:
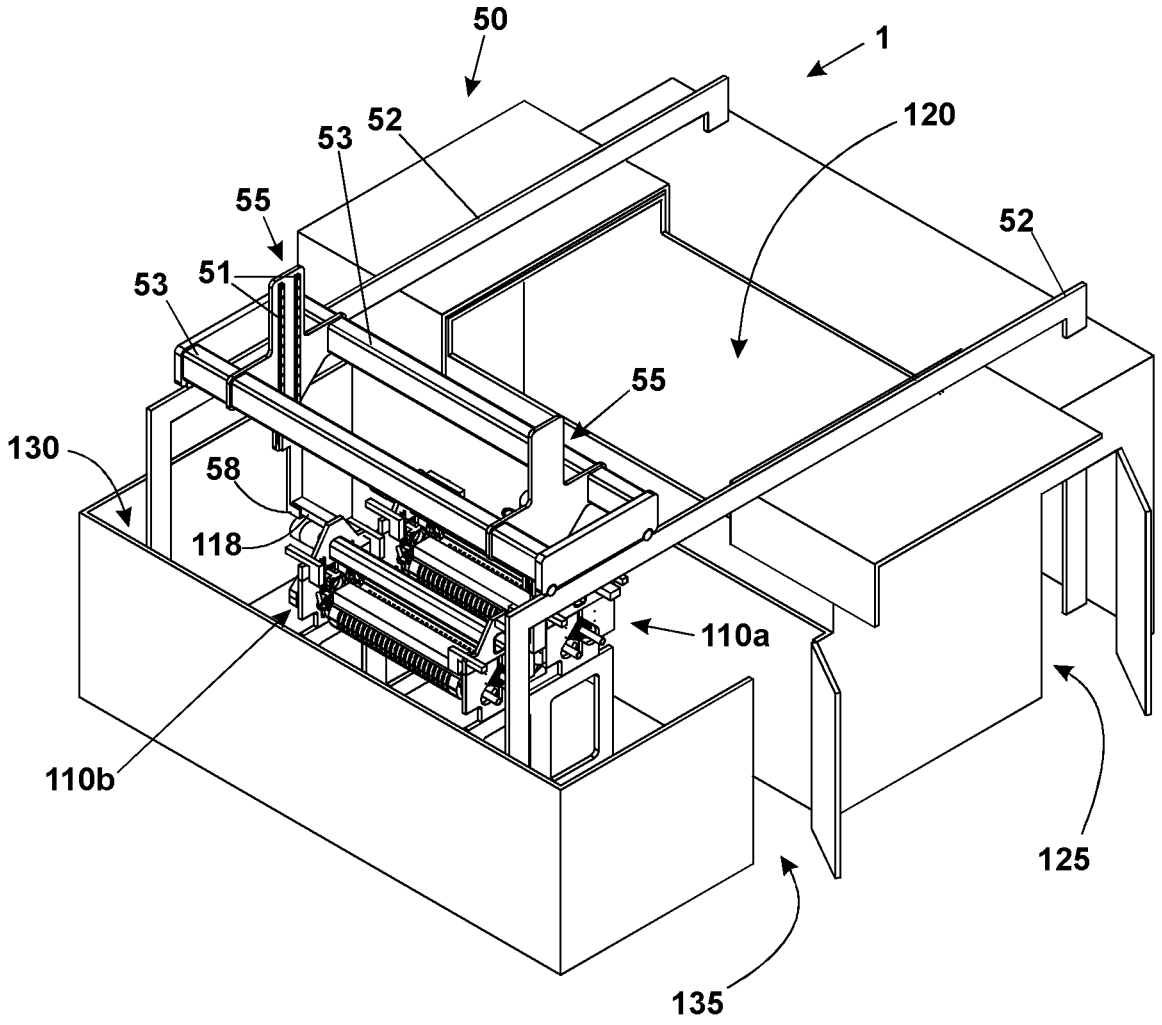
FIG. 19 diagrammatically shows a side elevation perspective view of a possible embodiment of the machine according to the invention.

Advantageously, for example with reference to the FIGS. 11 to 14, the engagement portions 58 and 118 can be provided with respective contacting surfaces 59 and 119. In particular, the engagement portions 58 and 118 can be provided, respectively, with at least a first contacting surface 59 and with at least a second contacting surface 119. More precisely, the aforementioned contacting surfaces 59 and 119 of the engagement portions 58 and 118, during the displacement between the assembled position and the disassembled position, in particular when are arranged in the engagement configuration, are positioned in contact with each other (FIG. 14). In the case that is diagrammatically shown as an example in the FIGS. 11 to 14 each engagement portion 58 and 118 is provided with 3 contacting surfaces 59 and 119.

In particular, the engagement portions 58 and 118 can be configured in such a way that during the movement from the assembled position to the disassembled position and vice versa, no relative motion occurs between the aforementioned respective contacting surfaces 59 and 119, or, however, there is no significant relative motion, that means excluding relative motion due to vibrations, or stresses, produced on the same during the displacement by the displacement group 50.

For example, at the engagement t configuration the contacting surface 119 of the engagement portion 118 is adapted to be in contact, for example to lay above, with the contacting surface 59 of the engagement portion 58 of the displacement group 50.

In particular, still as diagrammatically shown in the FIGS. 11 to 14, the engagement portion 58 can provide a portion protruding from the sliding portion 57, advantageously orthogonal to this. More precisely, the engagement portion 58 protruding from the sliding portion 57 can be configured to laterally contain an end portion 118' of the engagement portion 118, for example substantially flat. For example, the engagement portion 58 can be substantially "U-shaped" or "V-shaped". Preferably, a first and a second lateral wall 59'*a* and 59'*b* are adapted to laterally contain the engagement portion 118 at least at the aforementioned end portion 118' during the displacement between the assembled position and the disassembled position, in particular during the lifting or the lowering of the support body 110 with respect to the support frame 100 (see FIG. 14).

Advantageously, the engagement portions 58 and 118 can be configured to interlock with each other.

Therefore, the first support body 110*a* once engaged can be displaced by the displacement group 50 at the store area 130 where is positioned at a determined storing position 132*a*. Then, the displacement group 50 engages a second support body 110*b*, in particular positioned at a corresponding storing position. The second support body 110*b* is, therefore, displaced by the displacement group 50 at the working area 120, and, then, positioned on the support frame 100. Once that the second support body 110*b* has been moved in the assembled position, the detaching fingers 85*a* and 85*b* are, then, moved from the reference position to the working position in order to start a new production cycle.

In an alternative embodiment provided by the invention, if the connection duct 70 is of the type described above with reference to the FIGS. 21 to 23, the steps can be, furthermore, provided of positioning the aforementioned first and second portions 71 and 72 in the disconnection configuration, before displacing by the displacement group 50 the first support body 110*a* from the working area 120 to the store area 130. Advantageously, once that the second support body 110*b* has been positioned, by the displacement group 50, at the working position 120, the first and second portions 71 and 72 of the connection duct 70 are arranged in the connection configuration.

The aforementioned step of engaging by the engagement portions the displacement group 50 and the support body 110 and of positioning the first and second portions 71 and 72 of the connection duct 70 in the disconnection position, can be carried out simultaneously, or one before the other. The same can be said for the steps of positioning the first and second portions 71 and 72 of the connection duct 70 in the connection position and the positioning of the detaching fingers 85*a* and 85*b* from the reference position to the working position. In an alternative embodiment of the invention, a step can be provided of approaching or moving the detaching fingers 85*a* and 85*b* away with respect to each other, before displacing the support body 110*a* by the displacement group 50 to the store area 130. In this case, a step can be also provided of repositioning the detaching fingers 85*a* and 85*b* with respect to the folding or interfolding rolls 31 and 32 in a predetermined position before positioning the detaching fingers 85*a* and 85*b* in the working position. Advantageously, all the aforementioned steps, or at least a part of these, can be automatically managed, operated and controlled by the processing device 200.

Once that the new support body 110 has been positioned on the support frame 100, it is possible to block it by blocking devices in such a way to constrain their relative position. The blocking devices are not shown in the figure for simplicity. In some cases, during the replacement of a support body 110 with another, among the steps, it is possible to carry out a further step of positioning the folding or interfolding rolls 31 and 32 in a predetermined reference position, or a position zero. This further step can be particularly necessary in case that the folding or interfolding rolls 31 and 32 have the cutting blades 36 on board. In the case that the support body 110 comprises both the folding or interfolding group 30 and the cutting group 20, this further step can be omitted.

Figure 29:
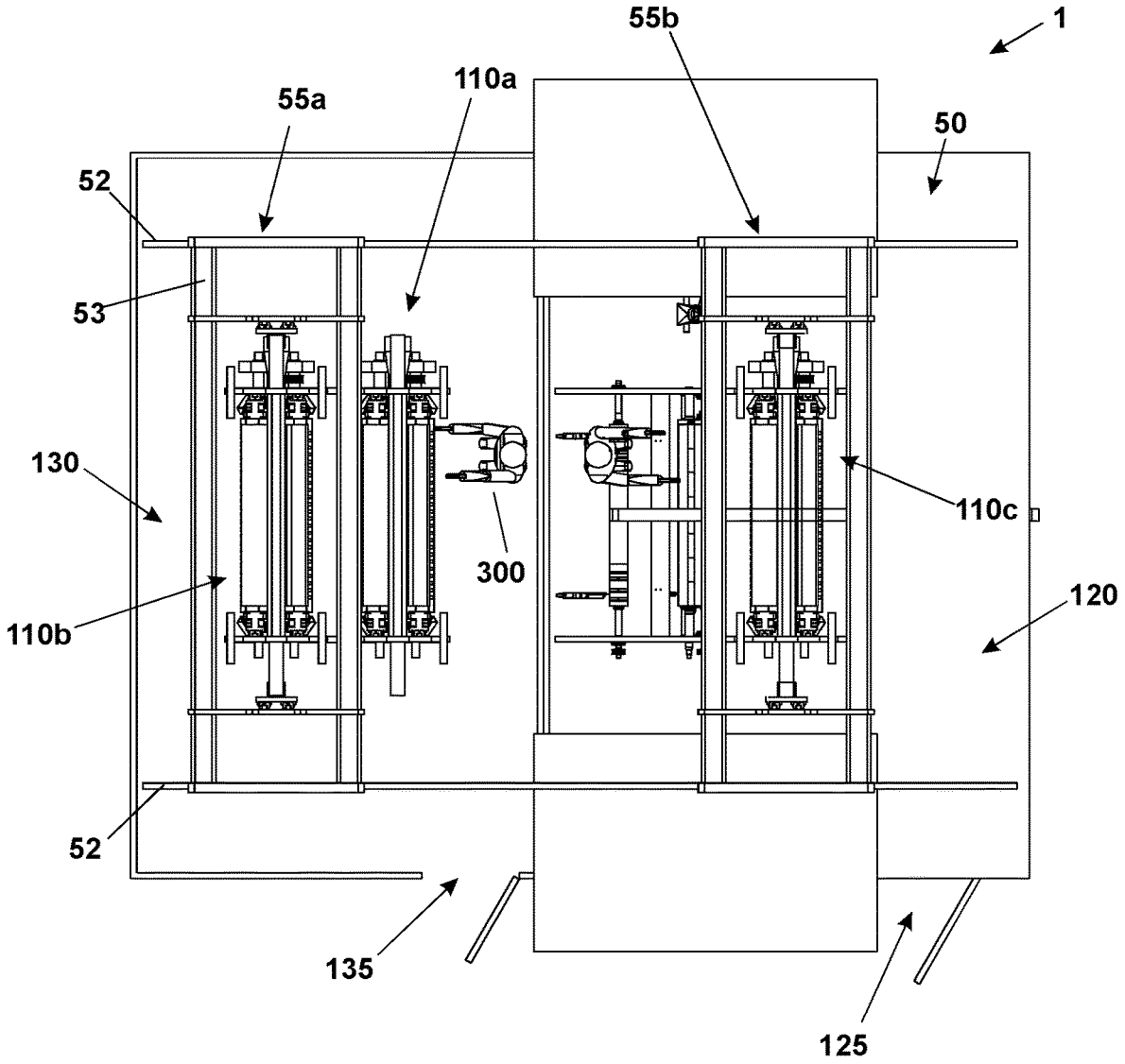
FIG. 29 diagrammatically shows a plan view of a possible alternative embodiment of the machine according to the invention.

In an alternative embodiment provided by the invention and diagrammatically shown in FIG. 29, the displacement group 50 comprises a first and a second support member 55*a* and 55*b*, advantageously, slidingly mounted on the same second guide member 52. In particular, each support member 55*a* and 55*b* can be configured to be positioned between a picking up position, at which is adapted to pick a respective support body 110 up, at the working area 120 or store area 130, and a waiting position, at which are adapted to engage outside the working area 120 and the store area 130, the support body 110 at the working area 120, or the store area 130, and then releasing the same at the store area 130, or the working area 120, where the aforementioned displacement of the support body 110 from the assembled position to the disassembled position can be carried out.

Figure 30:
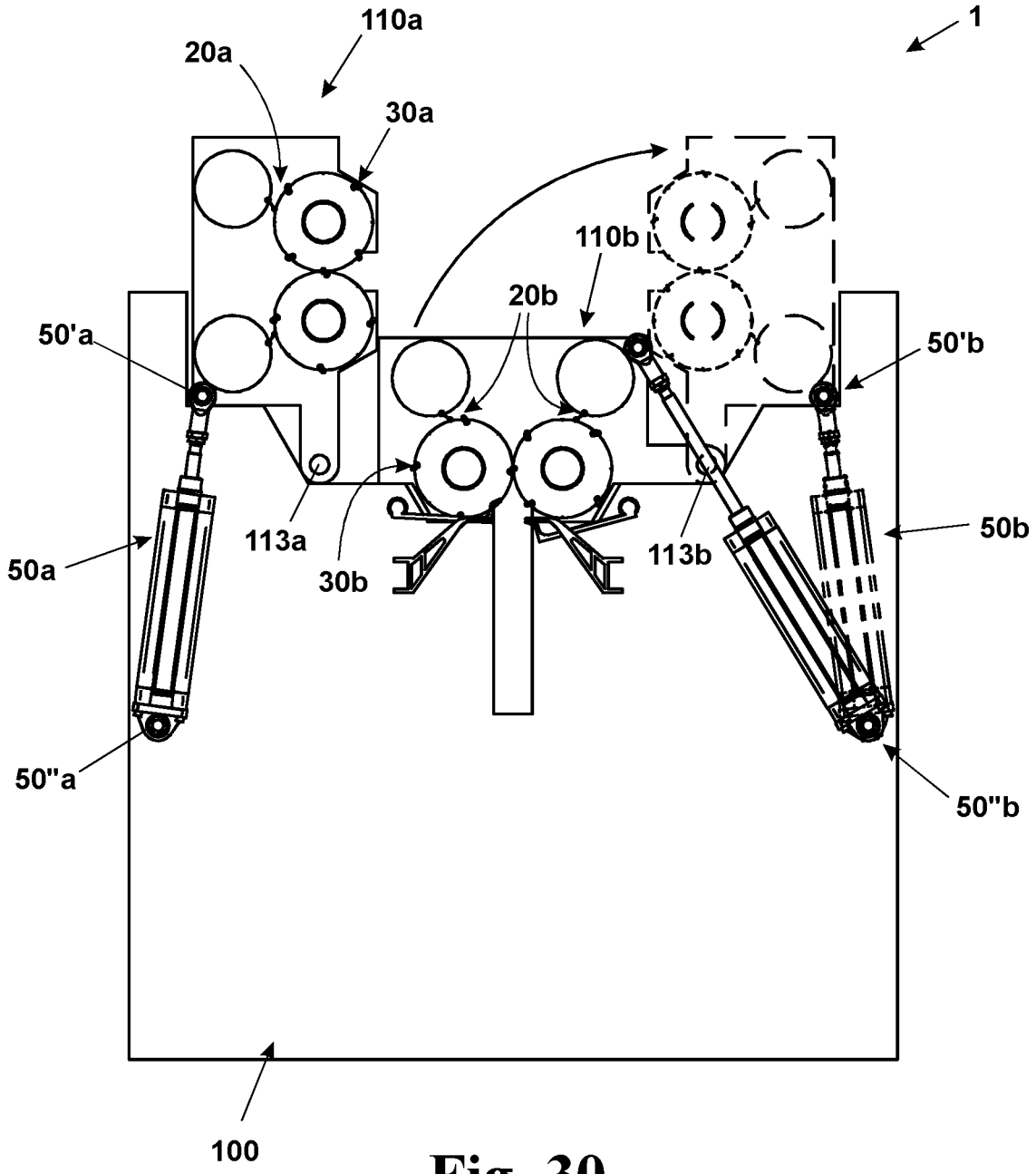
FIGS. 30 to 32 diagrammatically show front views of some working configurations of another alternative embodiment provided for the machine according to the invention.
Figure 31:
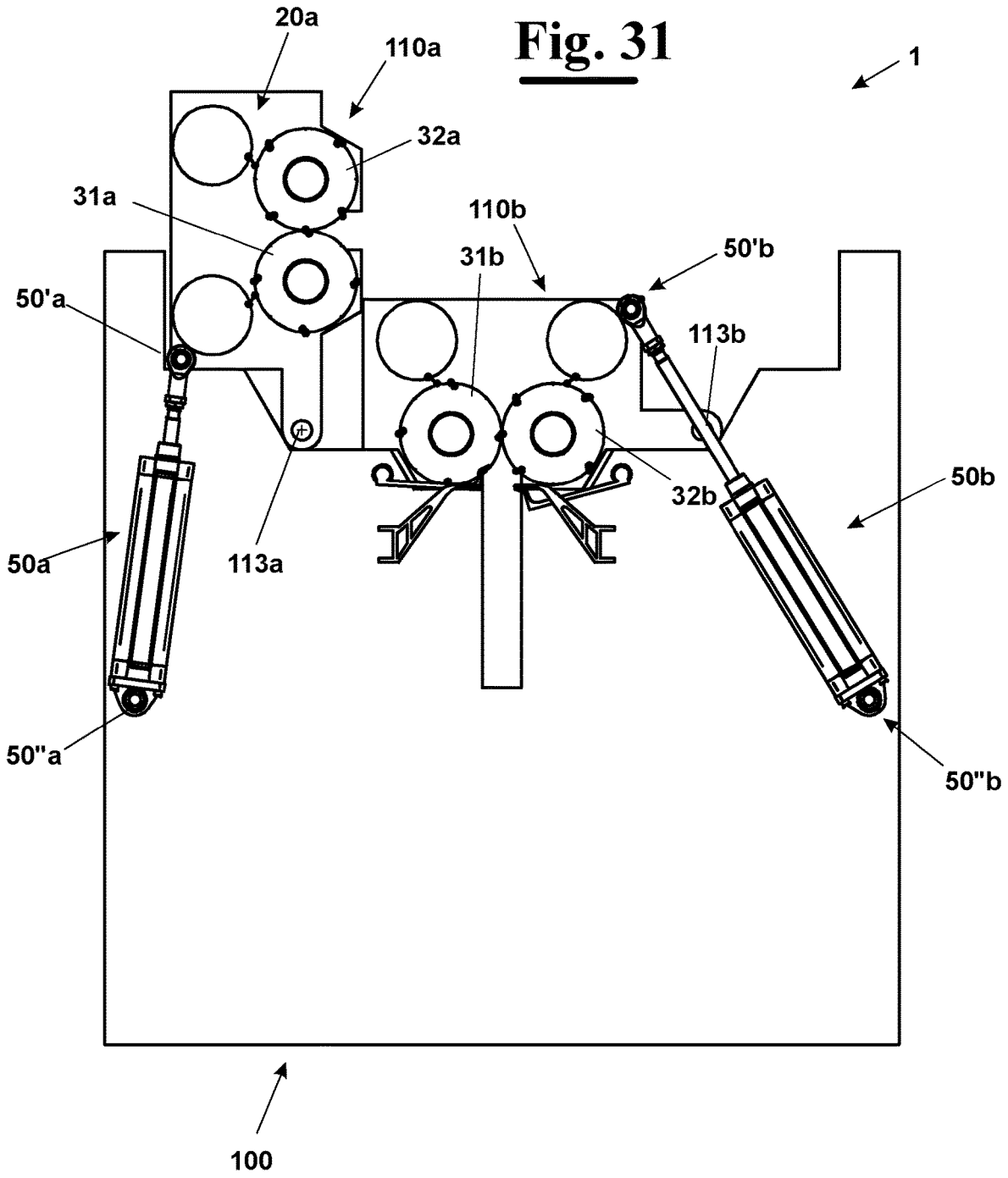
Figure 32:
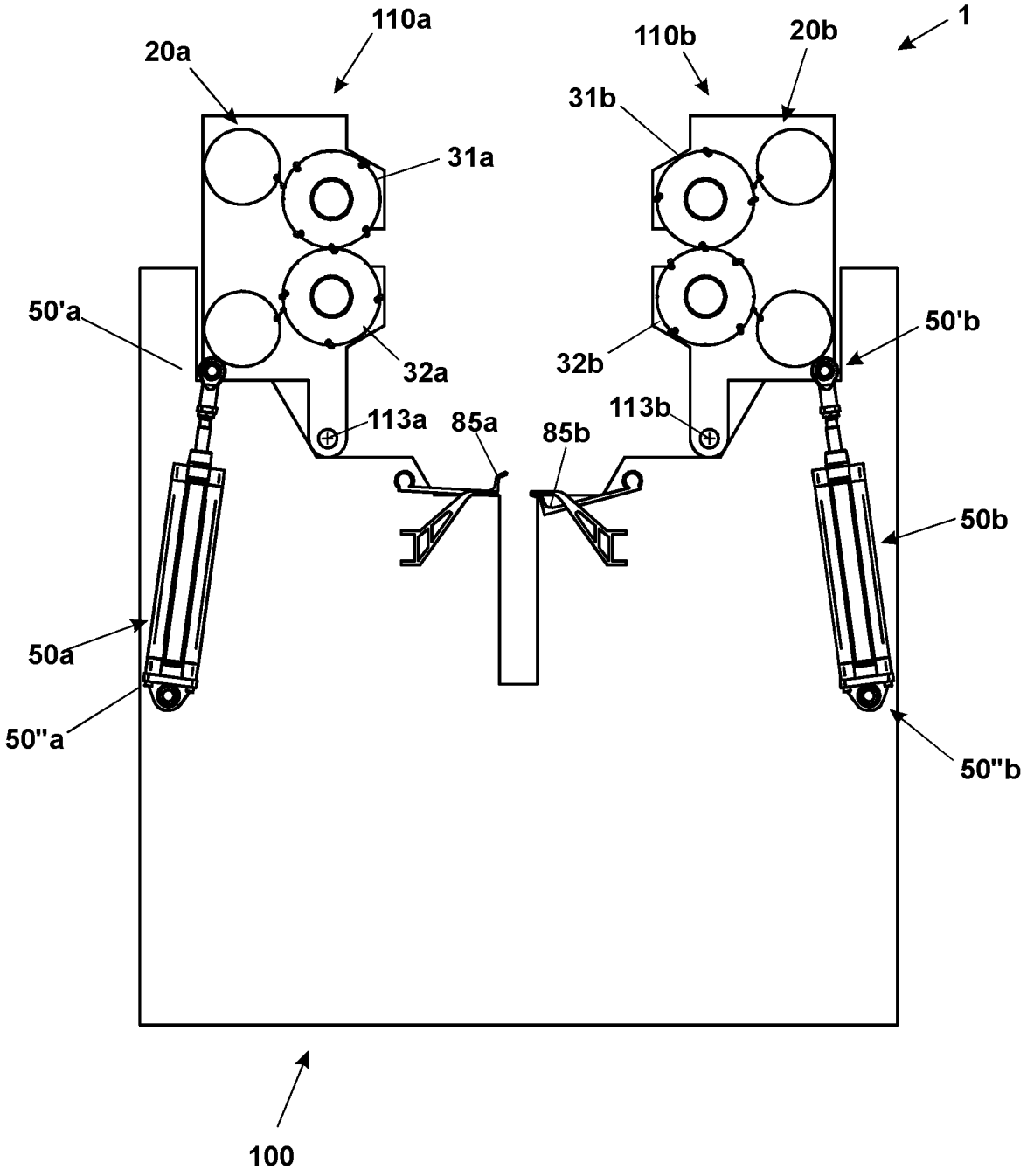

In the alternative embodiment diagrammatically shown in the FIGS. 30 to 32, the displacement group 50 is configured to move the support body 110 between the assembled position and the disassembled position by a rotation about at least a rotation axis 113, in particular parallel to the longitudinal rotation axes 131 and 132 of the folding or interfolding rolls 31 and 32. In particular, the displacement group 50 can comprise a first and a second displacement device 50*a* and 50*b*, for example a hydraulic, or pneumatic, or electromechanical, actuator, each of which operatively connected at a first engagement portion 50'*a* and 50'*b* to a respective support body 110*a* and 110*b* and pivotally connected, at a second engagement portion 50"*a* and 50"*b*, to the support frame 100. Each support body 110*a* and 110*b* can be, furthermore, pivotally connected to the support frame 100 at a respective point. When a support body, for example the support body 110*b*, has to be arranged in the disassembled position (indicated with a broken line in FIG. 30) to the assembled position (indicated with an unbroken line in FIG. 30), the respective displacement device 50*b* to cause the rotation of the support body 110*a*, or 110*b*, about a respective longitudinal rotation axis 113*a*, or 113*b*.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this departing reason, from the field of the invention. It is to be understood that the phraseology or terminology employed herein is for the purpose of description and not of limitation.

The invention claimed is:

1. A machine for producing packages of folded or interfolded laminar products made of paper material, in particular packages of napkins, tissues, towels, or similar products, said machine comprising a support frame configured to support:

a feeding group configured to feed a first and a second web of paper respectively along a first and a second predetermined feeding direction;

a cutting group configured to cut said first and second webs of paper, respectively, into a first and a second plurality of sheets of paper of predetermined length;

a folding or interfolding group equipped with a first and a second counter-rotating folding roll adapted to rotate about respective longitudinal rotation axes and configured to fold or interfold said first and second pluralities of sheets of paper at a folding or interfolding zone, in such a way to obtain a stack of sheets folded or interfolded according to a predetermined folding or interfolding configuration, said cutting group and said folding or interfolding group being mounted on a same support body configured to move between an assembled position in which is adapted to be supported by said support frame, and a disassembled position, in which is not adapted to be supported by said support frame;

said machine further comprising a displacement group configured to displace said support body between said assembled position and said disassembled position wherein said displacement group and said support body are provided with respective engagement portions configured to engage with each other in such a way to allow said displacement group to displace said support body between said assembled position and said disassembled position with respect to said support frame;

wherein said displacement group is configured to displace said support body from said assembled position to said disassembled position by lifting said support body from said support frame, and to displace said support body from said disassembled position to said assembled position by lowering said support body on said support frame.

2. The machine according to claim 1, wherein said displacement group is configured to displace said support body along a first displacement direction along which is adapted to lift or lower said support body with respect to said support frame, and at least along a second displacement direction.

3. The machine according to claim 2, wherein said first and second displacement directions are orthogonal to each other.

4. The machine according to claim 2 wherein said displacement group provides:

a first guide member oriented along said first displacement direction;

a second guide member oriented along said second displacement direction;

a support member configured to slide along said second guide member.

5. The machine according to claim 4, wherein said support member is provided with:

a base portion provided with said first guide member;

a sliding portion adapted to be slidingly mounted along said first guide member with respect to said base portion.

6. The machine according to claim 5, wherein said sliding portion is provided with said engagement portion.

7. The machine according to claim 1, wherein said displacement group is configured to displace said support body between said assembled position and said disassembled position by at least a rotation about at least one rotation axis parallel to said longitudinal rotation axes.

8. The machine according to claim 1, wherein said displacement group is configured to displace said support body between said assembled position and said disassembled position by a combination of movements comprising at least a translation and at least a rotation.

9. The machine according to claim 1, wherein a motor group is, furthermore, provided configured to cause at least one between said first and said second folding or interfolding roll to rotate about a respective rotation axis, said motor group comprising:

a main motor;

a motion transmission device comprising at least a motion transmission member configured to transmit the rotation motion of a rotation shaft of said main motor to at least one between said first and said second folding or interfolding roll.

10. The machine according to claim 9, wherein a group for adjusting the tension is, furthermore, provided configured to adjust the tension of said motion transmission member.

11. The machine according to claim 10, wherein said group for adjusting the tension is configured to keep substantially constant the tension of said motion transmission member during the movement of said support body between said assembled position and said disassembled position carried out by said displacement group.

12. The machine according to claim 11, wherein said group for adjusting the tension comprises a measurement device configured to measure the tension on said motion transmission member, said measurement device being operatively connected to a processing device configured to operate an actuation device configured to cause a lengthening or a shortening of the path of said motion transmission member according to a tension signal measured by said measurement device.

13. The machine according to claim 12, wherein said motion transmission member is slidingly mounted along a predetermined path defined by a plurality of guide pulleys and wherein said actuation device is configured to bring said guide pulleys near to each other, in such a way to cause a shortening of said path, or to move said guide pulleys away from each other, in such a way to cause a lengthening of said path.

14. The machine according to claim 1, wherein each said first and second folding or interfolding roll comprises:

a tubular body configured to rotate about a respective longitudinal rotation axis, said tubular body being provided with a plurality of suction holes organized in a plurality of couples of longitudinal rows close to each other;

a vacuum distribution device configured to selectively pneumatically connect a vacuum generation device configured to generate a predetermined vacuum degree at least at one row of the aforementioned plurality of rows of suction holes at predetermined angular positions of said tubular body, in such a way to cause said first and second pluralities of worked sheets of paper to be sucked and, therefore, adhere at predetermined portions of said folding or interfolding roll, said vacuum distribution device and said vacuum generation device being adapted to be pneumatically connected, or disconnected, by a connection duct comprising:

a first portion integral to said vacuum distribution device;

a second portion integral to said vacuum generation device, said first and second portions being configured to move between a connection configuration in which are adapted to pneumatically connect said vacuum generation device with said vacuum distribution device, and a disconnection configuration in which are adapted to pneumatically connect said vacuum distribution device to said vacuum generation device.

15. The machine according to claim 14, wherein said connection duct further comprises a third portion configured to cause said movement of said first and second portions of the connection duct between said connection configuration and said disconnection configuration, wherein:

said third portion is adapted to be slidingly mounted with respect to said first and second portions of said connection duct between a retracted position corresponding to said disconnection configuration, and an advanced position corresponding to said connection configuration, and at least one sealing element is positioned between said third portion and said first and/or second portion.

16. The machine according to claim 1, wherein said cutting group comprises a first and a second cutting device provided, respectively, with at least a first and a second cutting blade associated, respectively, to said first and to said second folding or interfolding roll, and wherein said first and second folding or interfolding rolls are, respectively, provided with a first and a second plurality of counter-blades configured to work, respectively, in combination with said first and second cutting blades to cut said respective web of paper into said respective plurality of sheets of paper.

17. The machine according to claim 1, wherein:

a first and a second plurality of detaching fingers configured, respectively, to cause said folded or interfolded sheets of paper to be detached from said first and from second folding or interfolding roll;

a first and a second driving group configured, respectively, to cause an oscillatory back and forth motion of said first and of said second plurality of detaching fingers towards/from said folding or interfolding zone, in such a way to cause said folded or interfolded sheets of paper to be detached from said first and from said second folding or interfolding roll, said first and second driving groups being adapted to move, respectively, said first and said second plurality of detaching fingers in a predetermined reference position before that said displacement group is adapted to move said support body between said assembled position and said disassembled position, wherein said first and second driving groups are configured to slide along a predetermined sliding direction orthogonal to said longitudinal rotation axes of said folding or interfolding rolls in such a way to approach or move away said first and second pluralities of detaching fingers with respect to each other; and said first and second driving groups are, furthermore, configured to delay or anticipate the oscillatory motion of said first and second pluralities of detaching fingers with respect to a predetermined reference oscillatory motion, in such a way to delay or anticipate the instant (tr) at which said first and second pluralities of detaching fingers are adapted to cause, respectively, the folded or interfolded sheets of paper to be detached, respectively, from said first and from said second folding or interfolding roll.

18. The machine according to claim 1, wherein, said engagement portions are provided with respective contacting surfaces positioned in contact with each other during said movement by said displacement group between said assembled position and said disassembled position, and wherein said engagement portions are configured in such a way that during said movement by said displacement group between said assembled position and said disassembled position, said contacting surfaces do not move with respect to each other.

19. A machine for producing packages of folded or interfolded laminar products made of paper material, in particular packages of napkins, tissues, towels, or similar products, said machine comprising a support frame configured to support:

a feeding group configured to feed a first and a second web of paper respectively along a first and a second predetermined feeding direction;

a cutting group configured to cut said first and second webs of paper, respectively, into a first and a second plurality of sheets of paper of predetermined length;

a folding or interfolding group equipped with a first and a second counter-rotating folding roll adapted to rotate about respective longitudinal rotation axes and configured to fold or interfold said first and second pluralities of sheets of paper at a folding or interfolding zone, in such a way to obtain a stack of sheets folded or interfolded according to a predetermined folding or interfolding configuration, said cutting group and said folding or interfolding group being mounted on a same support body configured to move between an assembled position in which is adapted to be supported by said support frame, and a disassembled position, in which is not adapted to be supported by said support frame;

said machine further comprising a displacement group configured to displace said support body between said assembled position and said disassembled position wherein said displacement group and said support body are provided with respective engagement portions configured to engage with each other in such a way to allow said displacement group to displace said support body between said assembled position and said disassembled position with respect to said support frame;

wherein said displacement group is configured to displace said support body between said assembled position and said disassembled position by at least a rotation about at least one rotation axis parallel to said longitudinal rotation axes.

20. A machine for producing packages of folded or interfolded laminar products made of paper material, in particular packages of napkins, tissues, towels, or similar products, said machine comprising a support frame configured to support:

a feeding group configured to feed a first and a second web of paper respectively along a first and a second predetermined feeding direction;

a cutting group configured to cut said first and second webs of paper, respectively, into a first and a second plurality of sheets of paper of predetermined length;

a folding or interfolding group equipped with a first and a second counter-rotating folding roll adapted to rotate about respective longitudinal rotation axes and configured to fold or interfold said first and second pluralities of sheets of paper at a folding or interfolding zone, in such a way to obtain a stack of sheets folded or interfolded according to a predetermined folding or interfolding configuration, said cutting group and said folding or interfolding group being mounted on a same support body configured to move between an assembled position in which is adapted to be supported by said support frame, and a disassembled position, in which is not adapted to be supported by said support frame;

said machine further comprising:

a displacement group configured to displace said support body between said assembled position and said disassembled position wherein said displacement group and said support body are provided with respective engagement portions configured to engage with each other in such a way to allow said displacement group to displace said support body between said assembled position and said disassembled position with respect to said support frame;

a first and a second plurality of detaching fingers configured, respectively, to cause said folded or interfolded sheets of paper to be detached from said first and from second folding or interfolding roll;

a first and a second driving group configured, respectively, to cause an oscillatory back and forth motion of said first and of said second plurality of detaching fingers towards/from said folding or interfolding zone, in such a way to cause said folded or interfolded sheets of paper to be detached from said first and from said second folding or interfolding roll, said first and second driving groups being adapted to move, respectively, said first and said second plurality of detaching fingers in a predetermined reference position before that said displacement group is adapted to move said support body between said assembled position and said disassembled position, wherein said first and second driving groups are configured to slide along a predetermined sliding direction orthogonal to said longitudinal rotation axes of said folding or interfolding rolls in such a way to approach or move away said first and second pluralities of detaching fingers with respect to each other; and said first and second driving groups are, furthermore, configured to delay or anticipate the oscillatory motion of said first and second pluralities of detaching fingers with respect to a predetermined reference oscillatory motion, in such a way to delay or anticipate the instant (tr) at which said first and second pluralities of detaching fingers are adapted to cause, respectively, the folded or interfolded sheets of paper to be detached, respectively, from said first and from said second folding or interfolding roll.

* * * * *